US007991319B2

(12) United States Patent
Aruga et al.

(10) Patent No.: US 7,991,319 B2
(45) Date of Patent: Aug. 2, 2011

(54) IMAGE FORMING APPARATUS WITH SEAL MEMBER THAT ABUTS SURFACE OF TONER CARRIER ROLLER HAVING CONVEX AND CONCAVE SECTIONS

(75) Inventors: Tomohiro Aruga, Matsumoto (JP); Masahiro Maeda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 283 days.

(21) Appl. No.: 12/348,747

(22) Filed: Jan. 5, 2009

(65) Prior Publication Data

US 2009/0180796 A1 Jul. 16, 2009

(30) Foreign Application Priority Data

Jan. 10, 2008 (JP) ..... 2008-002985

(51) Int. Cl.
*G03G 15/08* (2006.01)

(52) U.S. Cl. ..... 399/103; 399/252; 399/265; 399/279; 399/281; 399/286

(58) Field of Classification Search ..... 399/103, 399/252, 265, 279, 281, 286
See application file for complete search history.

(56) References Cited

U.S. PATENT DOCUMENTS

| | | | | |
|---|---|---|---|---|
| 4,625,676 | A * | 12/1986 | Sakamoto et al. | 399/276 |
| 4,674,439 | A * | 6/1987 | Sakamoto et al. | 399/267 |
| 4,760,422 | A | 7/1988 | Seimiya et al. | |
| 4,896,625 | A * | 1/1990 | Sakamoto et al. | 399/267 |
| 5,387,966 | A * | 2/1995 | Karashima | 399/286 |
| 7,024,137 | B2 | 4/2006 | Nittani et al. | |
| 7,155,151 | B2 | 12/2006 | Okamoto | |
| 7,215,909 | B2 | 5/2007 | Nittani et al. | |
| 2001/0005458 | A1 * | 6/2001 | Yamanaka et al. | 399/284 |
| 2003/0228173 | A1 | 12/2003 | Nittani et al. | |
| 2005/0185980 | A1 | 8/2005 | Okamoto | |
| 2006/0013618 | A1 | 1/2006 | Nittani et al. | |
| 2007/0212088 | A1 | 9/2007 | Koike et al. | |
| 2009/0148197 | A1 * | 6/2009 | Yamada et al. | 399/286 |

FOREIGN PATENT DOCUMENTS

| | | | |
|---|---|---|---|
| EP | 1422577 | A2 | 5/2004 |
| JP | 05142938 | A | 6/1993 |
| JP | 06083228 | A * | 3/1994 |
| JP | 07-084449 | | 3/1995 |

(Continued)

OTHER PUBLICATIONS

JP 06083228 A English Translation to Murayama et al.*

(Continued)

*Primary Examiner* — Ryan Walsh
(74) *Attorney, Agent, or Firm* — DLA Piper LLP (US)

(57) ABSTRACT

In an image forming apparatus, a toner carrier roller rotatably mounted to a housing that stores toner rotates to convey toner to an opposed position facing a latent image carrier outside the housing. A plurality of convex sections are regularly arranged on a surface of the roller in an axial direction parallel to the rotational axis and in a circumferential direction orthogonal to the axial direction and parallel to a circumferential surface of the roller and a concave section surrounds the convex sections. A seal member abuts the surface of the roller moving from the outside toward the inside of the housing at a position downstream of the opposed position in a rotation direction of the roller to prevent toner leakage from inside the housing. The roller moves relative to the seal member in the axial direction.

9 Claims, 17 Drawing Sheets

FOREIGN PATENT DOCUMENTS

| | | | |
|---|---|---|---|
| JP | 2002006632 | A | 1/2002 |
| JP | 2003-057940 | | 2/2003 |
| JP | 2005181713 | A | 7/2005 |
| JP | 2007-121948 | | 5/2007 |
| JP | 2007-140080 | | 6/2007 |
| JP | 2007-199423 | | 8/2007 |
| JP | 2007199424 | A | 8/2007 |
| JP | 2007-240563 | | 9/2007 |

OTHER PUBLICATIONS

European search report for corresponding European application 09000136.3 lists the references above.

* cited by examiner $\underline{\beta = \alpha}$

IMAGE FORMING APPARATUS WITH SEAL MEMBER THAT ABUTS SURFACE OF TONER CARRIER ROLLER HAVING CONVEX AND CONCAVE SECTIONS

CROSS REFERENCE TO RELATED APPLICATION

The disclosure of Japanese Patent Application No. 2008-2985 filed on Jan. 10, 2008 including specification, drawings and claims is incorporated herein by reference in its entirety.

BACKGROUND

1. Technical Field

This invention relates to an image forming apparatus, a developing device and an image forming method using a toner carrier roller having a regular convexo-concave pattern on a surface thereof.

2. Related Art

In techniques for developing an electrostatic latent image carried on an image carrier with toner, an apparatus is widely used which includes a toner carrier roller which is shaped approximately like a cylinder, carries toner on a surface thereof, and is arranged opposed facing the image carrier. For the purpose of improving the characteristics of toner carried on the surface of such a toner carrier roller, the applicant of the present application has earlier disclosed a structure of a toner carrier roller having a cylindrical shape that the surface of the roller includes convex sections which are regularly arranged and a concave section which surrounds the convex sections (JP-A-2007-121948). Since the concavo-convex patterns in the surface are regulated and uniform, such a structure is advantageous in that it permits easy control of the thickness of a toner layer which is carried on the surface of the roller, the charge level and the like.

In an image forming apparatus constructed as described above, a seal which comes into contact with a developing roller surface is provided in a clearance between a developing roller as a toner carrier roller and a developer housing to prevent the leakage of toner.

SUMMARY

In the above related art, the seal is brought into contact in a rotation direction of the developing roller, that is, a so-called trail direction to prevent the toner on the developing roller surface from being scraped off. However, since the seal member is pressed into contact with the developing roller having the toner adhering to the surface thereof, it is unavoidable that the toner adheres to the surface of the seal member. Such adhesion of the toner to the seal member could become a cause of toner leakage resulting from a seal defect or filming resulting from the adhesion of the fixed toner to the developing roller surface.

Particularly in the case of providing the regular convexo-concave pattern on the toner carrier roller as in the above related art, the toner adhesion to the seal member also appears with regularity. Thus, it is thought that toner leakage, filming or the like is likely to be induced by such local toner adhesion.

An advantage of some aspects of the invention is to provide technology capable of preventing problems such as toner leakage and filming resulting from toner adhesion to a seal member in an image forming apparatus, a developing device and an image forming method using a toner carrier roller having a regular convexo-concave pattern on a surface thereof.

According to a first aspect of the invention, there is provided an image forming apparatus, comprising: a latent image carrier that carries an electrostatic latent image; a housing that stores toner inside; a toner carrier roller that is shaped approximately like a cylinder, is mounted to the housing rotatably about a rotational axis, rotates while carrying toner on a surface thereof to convey the toner to an opposed position facing the latent image carrier outside the housing, and is provided, on the surface thereof, with a plurality of convex sections which are regularly arranged in an axial direction parallel to the rotational axis and in a circumferential direction orthogonal to the axial direction and parallel to a circumferential surface of the toner carrier roller and a concave section which surrounds the convex sections; a seal member that is arranged in abutting contact with the surface of the toner carrier roller moving from the outside the housing toward the inside the housing at a position downstream of the opposed position in a rotation direction of the toner carrier roller to prevent toner leakage from the inside the housing; and a moving mechanism that relatively moves the toner carrier roller relative to the seal member in the axial direction.

The regular toner adhesion to the seal member described above occurs because a regular convexo-concave pattern is provided on the surface of the toner carrier roller that comes in abutting contact with the seal member. In other words, the toner carrier roller acts to scrape off the toner adhering to the seal member by the contact of the convexo-concave surface thereof with the seal member. Since the magnitude of this action has regularity in conformity with the regular convexo-concave pattern of the toner carrier roller surface, the toner adhering to and remaining on the surface of the seal member also has a regular pattern.

In the invention constructed as above, the toner carrier roller is relatively moved relative to the seal member in the axial direction parallel to the rotational axis of the toner carrier roller. By changing the positional relationship of the toner carrier roller and the seal member at their contact position in this way, the regular toner adhesion to the seal member can be solved to prevent problems such as toner leakage and filming. Particularly, in recent years, the use of low melting point toner has been required for power saving of apparatuses and such low melting point toner is likely to cause fixation to the seal member or the like. The effects of the invention effectively act also on image forming apparatuses using low melting point toner.

According to a second aspect of the invention, there is provided a developing device, comprising: a housing that stores toner inside; a toner carrier roller that is shaped approximately like a cylinder, is mounted to the housing rotatably about a rotational axis, rotates while carrying toner on a surface thereof to convey the toner to outside the housing, and is provided, on the surface thereof, with a plurality of convex sections which are regularly arranged in an axial direction parallel to the rotational axis and in a circumferential direction orthogonal to the axial direction and parallel to a circumferential surface of the toner carrier roller and a concave section which surrounds the convex sections; and a seal member that is arranged in abutting contact with the surface of the toner carrier roller moving from the outside the housing toward the inside the housing to prevent toner leakage from the inside the housing, wherein the convex sections are arranged in the axial direction at a specified arrangement pitch, and wherein the toner carrier roller and the seal member are so constructed and arranged that the toner carrier roller is relatively movable relative to the seal member in the axial direction by a distance equal to or larger than half the arrangement pitch.

In the developing device thus constructed, problems such as toner leakage and filming can be prevented by solving local toner adhesion to the seal member similar to the above image forming apparatus according to the invention.

According to a third aspect of the invention, there is provided an image forming method, comprising: causing a toner carrier roller to carry toner stored in a housing, the toner carrier roller being shaped approximately like a cylinder, being rotatable about a rotational axis, and being provided, on a surface thereof, with a plurality of convex sections which are regularly arranged in an axial direction parallel to the rotational axis and in a circumferential direction orthogonal to the axial direction and parallel to a circumferential surface of the toner carrier roller and a concave section which surrounds the convex sections, the convex sections being arranged in the axial direction at a specified arrangement pitch; rotating the toner carrier roller to convey the toner to an opposed position facing a latent image carrier that carries an electrostatic latent image, thereby developing the electrostatic latent image with the toner; bringing a seal member into abutting contact with the surface of the toner carrier roller at a position downstream of the opposed position in a rotation direction of the toner carrier roller, thereby collecting the toner into the housing; and executing selectively either one of two rotation modes in which relative positions of the seal member and the toner carrier roller in the axial direction differ by an odd number multiple of half the arrangement pitch to rotate the toner carrier roller In the invention thus constructed, the regular toner adhesion to the seal member can be counteracted by executing the two rotation modes. Thus, problems such as toner leakage and filming resulting from local toner adhesion to the seal member can be prevented.

According to a fourth aspect of the invention, there is provided an image forming method, comprising: causing a toner carrier roller to carry toner stored in a housing, the toner carrier roller being shaped approximately like a cylinder, being rotatable about a rotational axis, and being provided, on a surface thereof, with a plurality of convex sections which are regularly arranged in an axial direction parallel to the rotational axis and in a circumferential direction orthogonal to the axial direction and parallel to a circumferential surface of the toner carrier roller and a concave section which surrounds the convex sections, the convex sections being arranged in the axial direction at a specified arrangement pitch; rotating the toner carrier roller to convey the toner to an opposed position facing a latent image carrier that carries an electrostatic latent image, thereby developing the electrostatic latent image with the toner; bringing a seal member into abutting contact with the surface of the toner carrier roller at a position downstream of the opposed position in a rotation direction of the toner carrier roller, thereby collecting the toner into the housing; and executing a removal operation by relatively moving the toner carrier roller relative to the seal member by a distance equal to or larger than half the arrangement pitch while rotating the toner carrier roller.

In the invention thus constructed, the toner adhering to the seal member can be removed by changing the relative position of the toner carrier roller relative to the seal member in the axial direction while rotating the toner carrier roller. Thus, problems such as toner leakage and filming resulting from local toner adhesion to the seal member can be prevented.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

Figure 1:
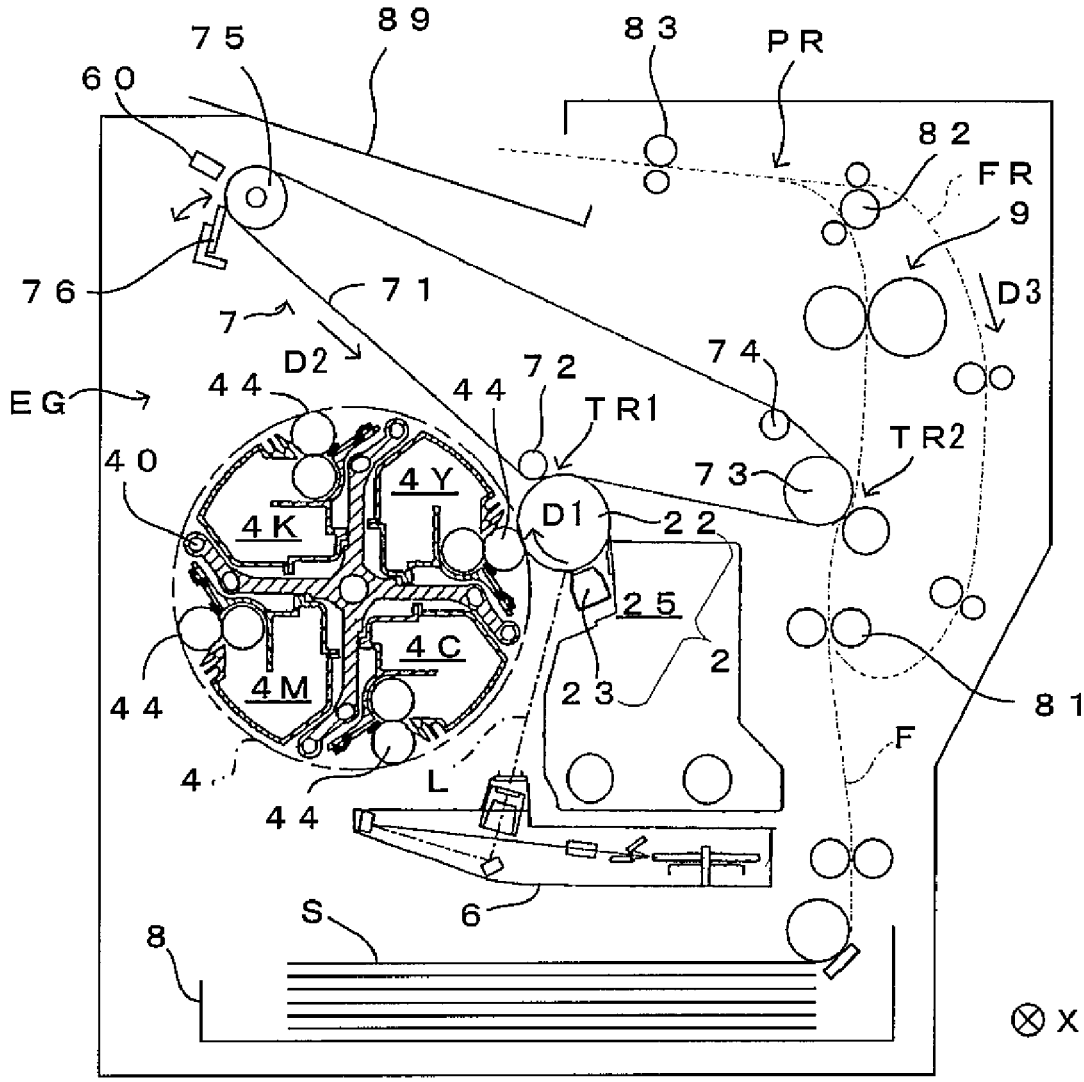
FIG. 1 is a diagram showing an exemplary construction of an image forming apparatus to which the invention is preferably applicable.

Four embodiments of an image forming apparatus according to the invention are described below. These embodiments are identical in basic construction and operation although the construction and operation of developers partly differ as described later. Accordingly, the basic construction and operation of the apparatus common to the respective embodiments are first described here, and then, characteristic parts of the respective embodiments are described. The same constructions are identified by the same reference numerals in the respective embodiments.

Figure 2:
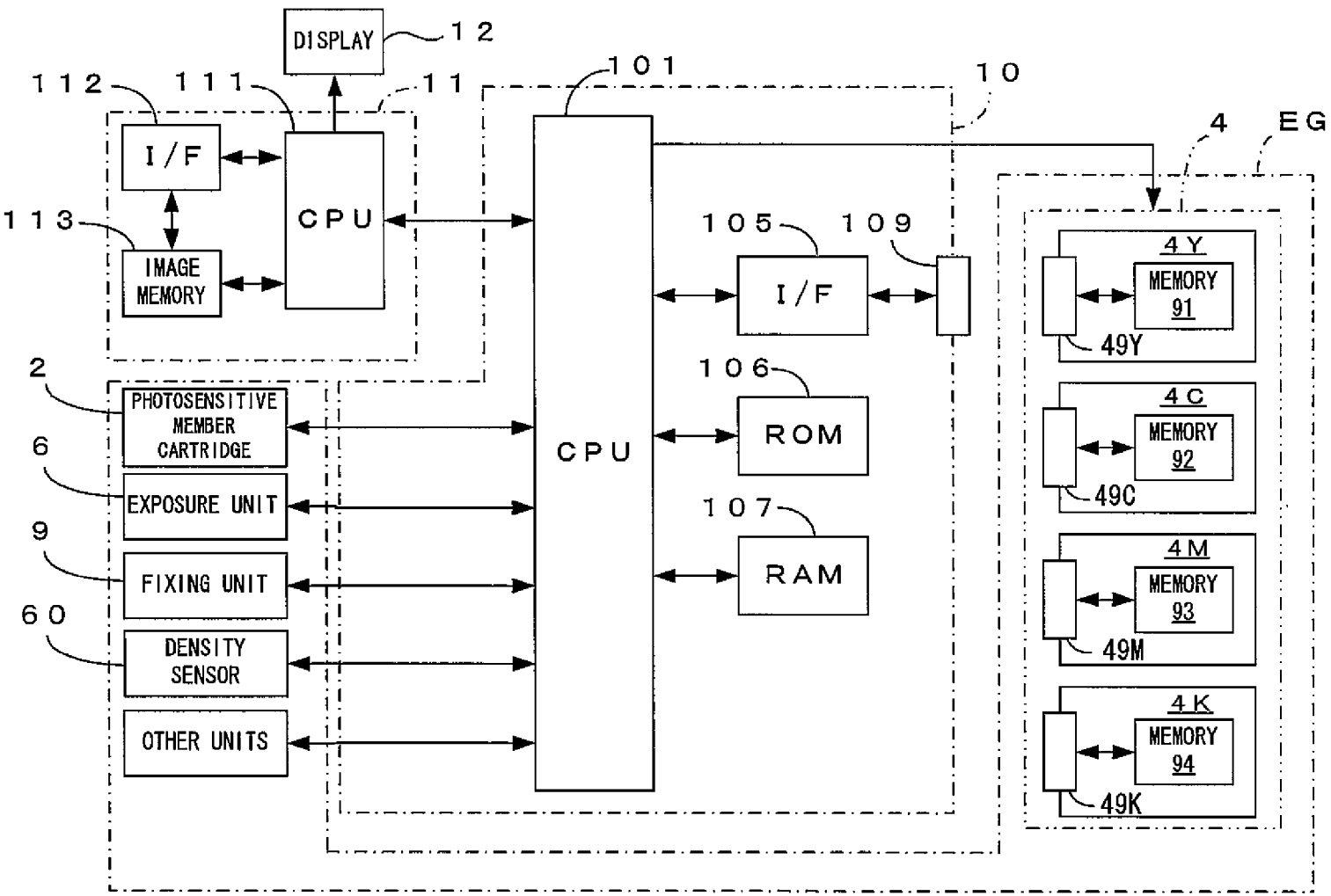
FIG. 2 is a block diagram of an electric structure of the image forming apparatus shown in FIG. 1.

FIG. 1 is a diagram showing an exemplary construction of an image forming apparatus to which the invention is preferably applicable. FIG. 2 is a block diagram of an electric structure of the image forming apparatus shown in FIG. 1. This apparatus is an image forming apparatus which overlays toner in four colors of yellow (Y), cyan (C), magenta (M) and black (K) one atop the other and accordingly forms a fullcolor image, or forms a monochromatic image using only black toner (K). In the image forming apparatus, when an image signal is fed to a main controller 11 from an external apparatus such as a host computer, a CPU 101 provided in an engine controller 10 controls respective portions of an engine part EG in accordance with an instruction received from the main controller 11 to perform a predetermined image forming operation, and accordingly, an image which corresponds to the image signal is formed on a sheet S.

In the engine part EG, a photosensitive member 22 is disposed so that the photosensitive member 22 can freely rotate in an arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a waste toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from an apparatus main body as one integrated unit.

An exposure unit 6 emits a light beam L toward the outer circumferential surface of the photosensitive member 22 charged by the charger unit 23. This exposure unit 6 exposes the photosensitive member 22 by the light beam L in accordance with the image signal given from the external apparatus to form an electrostatic latent image corresponding to the image signal.

The developer unit 4 develops thus formed electrostatic latent image with toner. Specifically, the developer unit 4 includes a support frame 40 which is provided rotatable about a rotation shaft orthogonal to a plane of FIG. 1 and a yellow developer 4Y, a cyan developer 4C, a magenta developer 4M and a black developer 4K which are freely attachable to and detachable from the support frame 40 as cartridges and house toner of the respective colors. An engine controller 10 controls the developer unit 4. The developer unit 4 is driven into rotation based on a control instruction from the engine controller 10. When the developers 4Y, 4C, 4M and 4K are selectively positioned at a predetermined developing position which is faced with the photosensitive member 22 over a predetermined gap, the developing roller 44 which is disposed in this developer and carries a toner of a selected color is positioned facing the photosensitive member 22, and the developing roller 44 supplies the toner onto the surface of the photosensitive member 22 at the facing position. In this way, the electrostatic latent image on the photosensitive member 22 is visualized with the toner of the selected color.

Figure 3:
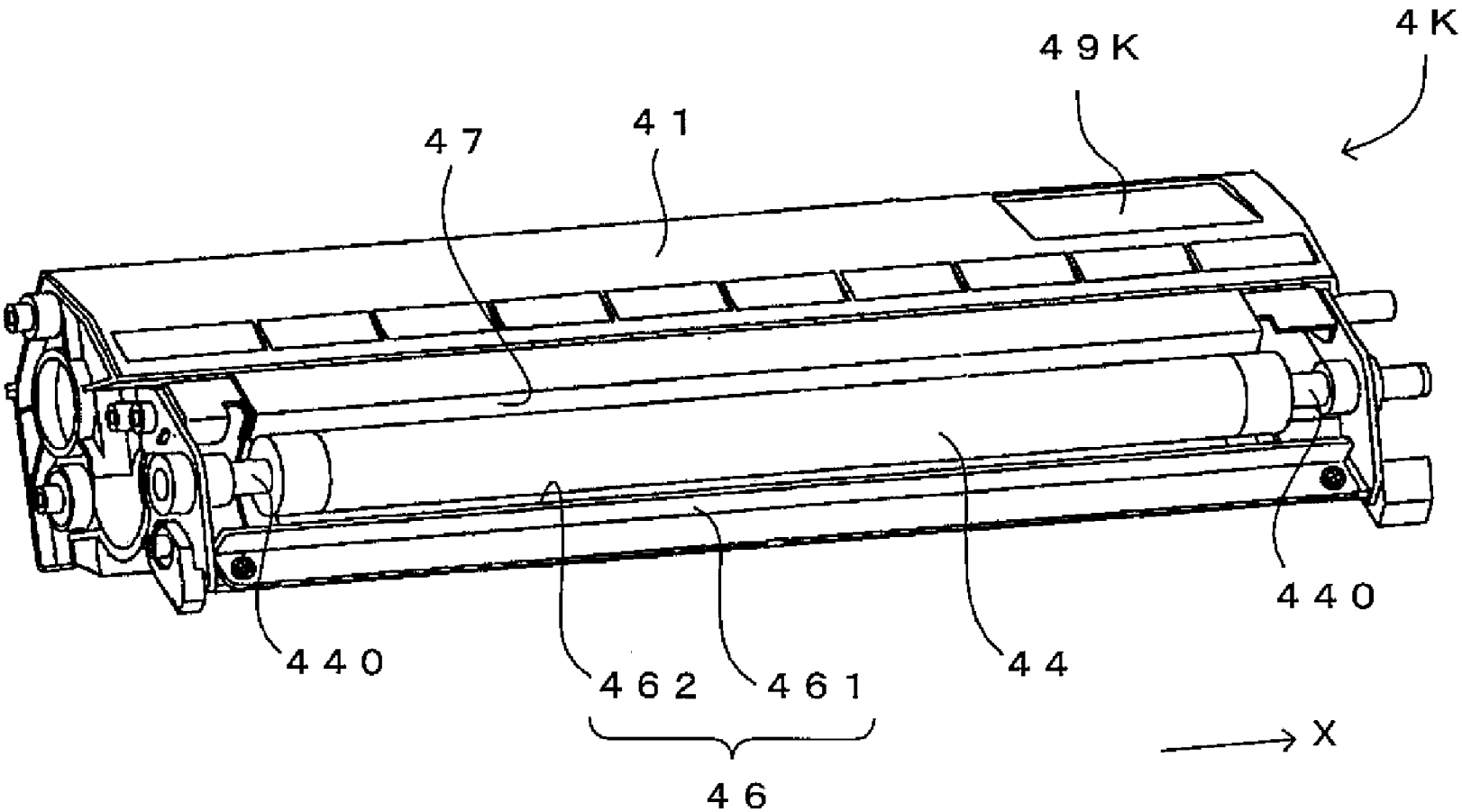
FIG. 3 is a diagram showing the appearance of the developer.
Figure 4A:
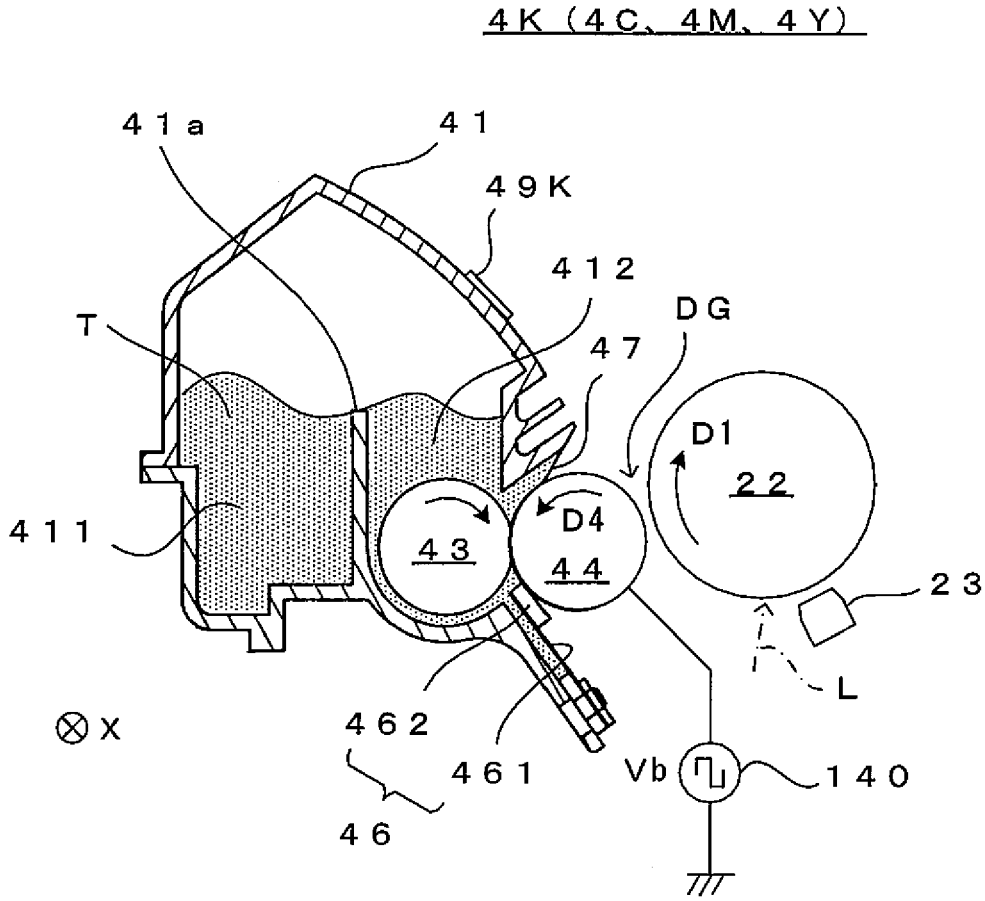
FIG. 4A is a cross sectional view showing a structure of the developer.
Figure 4B:
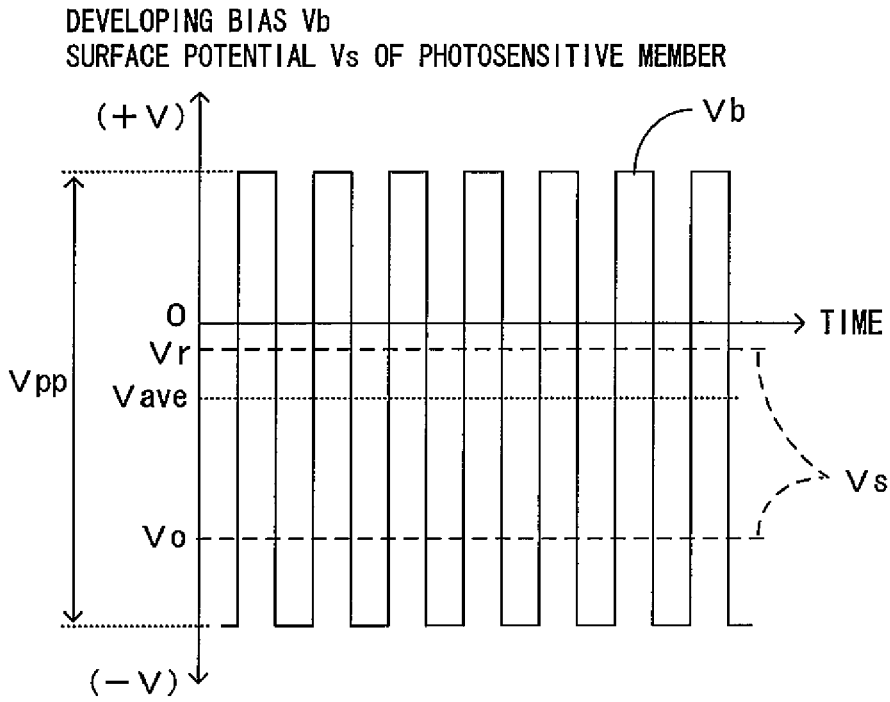
FIG. 4B is a graph showing the relationship between a waveform of a developing bias and a surface potential of the photosensitive member.

FIG. 3 is a diagram showing the appearance of the developer. FIG. 4A is a cross sectional view showing a structure of the developer, and FIG. 4B is a graph showing the relationship between a waveform of a developing bias and a surface potential of the photosensitive member. The developers 4Y, 4C, 4M and 4K have identical structures. Therefore, the structure of the developer 4K will now be described in further detail with reference to FIGS. 3 and 4A. The other developers 4Y, 4C and 4M have the same structures and functions, to be noted.

In the developer 4K, a feed roller 43 and a developing roller 44 are rotatably attached with a shaft to a housing 41 which houses monocomponent toner T inside. When the developer 4K is positioned at the developing position described above, the developing roller 44 is positioned at a facing position which is faced with the photosensitive member 22 over a developing gap DG, and these rollers 43 and 44 are engaged with a rotation driver (not shown) which is provided in the main body to rotate in a predetermined direction. The feed roller 43 is shaped like a cylinder and is made of an elastic material such as foamed urethane rubber and silicone rubber. The developing roller 44 is shaped like a cylinder and is made of metal or alloy such as copper, aluminum and stainless steel. The two rollers 43 and 44 rotate while staying in contact with each other, and accordingly, the toner is rubbed against the surface of the developing roller 44 and a toner layer having a predetermined thickness is formed on the surface of the developing roller 44. Although negatively-charged toner is used in this embodiment, positively-charged toner may be used instead.

The space inside the housing 41 is divided by a partition wall 41a into a first chamber 411 and a second chamber 412. The feed roller 43 and the developing roller 44 are both provided in the second chamber 412. With a rotation of these rollers, toner within the second chamber 412 flows and is fed to the surface of the developing roller 44 while getting agitated. Meanwhile toner stored inside the first chamber 411 would not be moved by the rotation since it is isolated from the feed roller 43 and the developing roller 44. This toner is mixed with toner stored in the second chamber 412 and is agitated by the rotation of the developer unit 4 while holding the developer.

As described above, in this developer, the inside of the housing is separated into the two chambers, and the side walls of the housing 41 and the partition wall 41a surround the feed roller 43 and the developing roller 44, and accordingly, the second chamber 412 of relatively small volume is provided. Therefore, even when a remaining toner amount is small, toner is supplied efficiently to near the developing roller 44. Further, supply of toner from the first chamber 411 to the second chamber 412 and agitation of the whole toner are performed by the rotation of the developer unit 4. Hence, an auger-less structure is realized that an agitator member (auger) for agitating toner is not provided inside the developer.

Further, in the developer 4K, a restriction blade 46 is disposed which restricts the thickness of the toner layer formed on the surface of the developing roller 44 into the predetermined thickness. The restriction blade 46 includes a plate-like member 461 made of elastic material such as stainless steel, phosphor bronze or the like and an elastic member 462 which is attached to a front edge of the plate-like member 461 and is made of a resin member such as a silicone rubber and a urethane rubber. A rear edge of the plate-like member 461 is fixed to the housing 41. The elastic member 462 attached to the front edge of the plate-like member 461 is positioned on the upstream side to the rear edge of the plate-like member 461 in a rotation direction D4 of the developing roller 44 shown by an arrow in FIG. 4A. The elastic member 462 elastically abuts on the surface of the developing roller 44 to form a restriction nip, thereby restricting the toner layer formed on the surface of the developing roller 44 finally into the predetermined thickness.

The toner layers thus formed on the surface of the developing roller 44 are transported, by means of the rotation of the developing roller 44, one after another to the opposed positions against the photosensitive member 22 on the surface of which an electrostatic latent image is formed. The developing bias from a bias power source 140 controlled by the engine controller 10 is applied to the developing roller 44. As shown in FIG. 4B, a surface potential Vs of the photosensitive member 22 drops down approximately to a residual potential Vr at exposed segments exposed by the light beam L from the exposure unit 6 after getting uniformly charged by the charger unit 23, but stays at an almost uniform potential Vo at non-exposed segments not exposed by the light beam L. Meanwhile, the developing bias Vb applied to the developing roller 44 is a rectangular-wave AC voltage on which a DC potential Vave is superimposed, and its peak-to-peak voltage will be hereinafter denoted at Vpp. With application of such a developing bias Vb, toner carried on the developing roller 44 is made jump across a developing gap DG and partially adheres to the respective sections in the surface of the photosensitive member 22 in accordance with the surface potential Vs of the photosensitive member 22, whereby an electrostatic latent image on the photosensitive member 22 is visualized as a toner image in the color of the toner.

A rectangular-wave voltage having a peak-to-peak voltage Vpp of 1500V and a frequency of about 3 kHz, for example, may be used as the developing bias voltage Vb. Since an electric potential difference between the direct current component Vave of the developing bias voltage Vb and a residual potential Vr of the photosensitive member 22 constitutes a so-called development contrast which affects image density, the direct current component Vave may be set to a required value for obtaining a predetermined image density.

The housing 41 further includes a seal member 47 which is pressed against the surface of the developing roller 44 on the downstream side to the opposed position facing the photosensitive member 22 in the rotation direction of the developing roller 44. The seal member 47 is a belt-like film made of a flexible material such as polyethylene, nylon or fluororesin extending in a direction X parallel to a rotational axis of the developing roller 44. One end of the seal member 47 in a direction perpendicular to the longitudinal direction X is fixed to the housing 41, and the other end of the seal member 47 abuts on the surface of the developing roller 44. The other end of the seal member 47 is allowed to abut on the developing roller 44 as directed toward the downstream side in the rotation direction D4 of the developing roller 44, or directed in a so-called trail direction. The other end of the seal member 47 guides toner which remains on the surface of the developing roller 44 after moving past the opposed position facing the photosensitive member 22 to inside the housing 41 and prevents toner inside the housing from leaking to outside.

Figure 5:
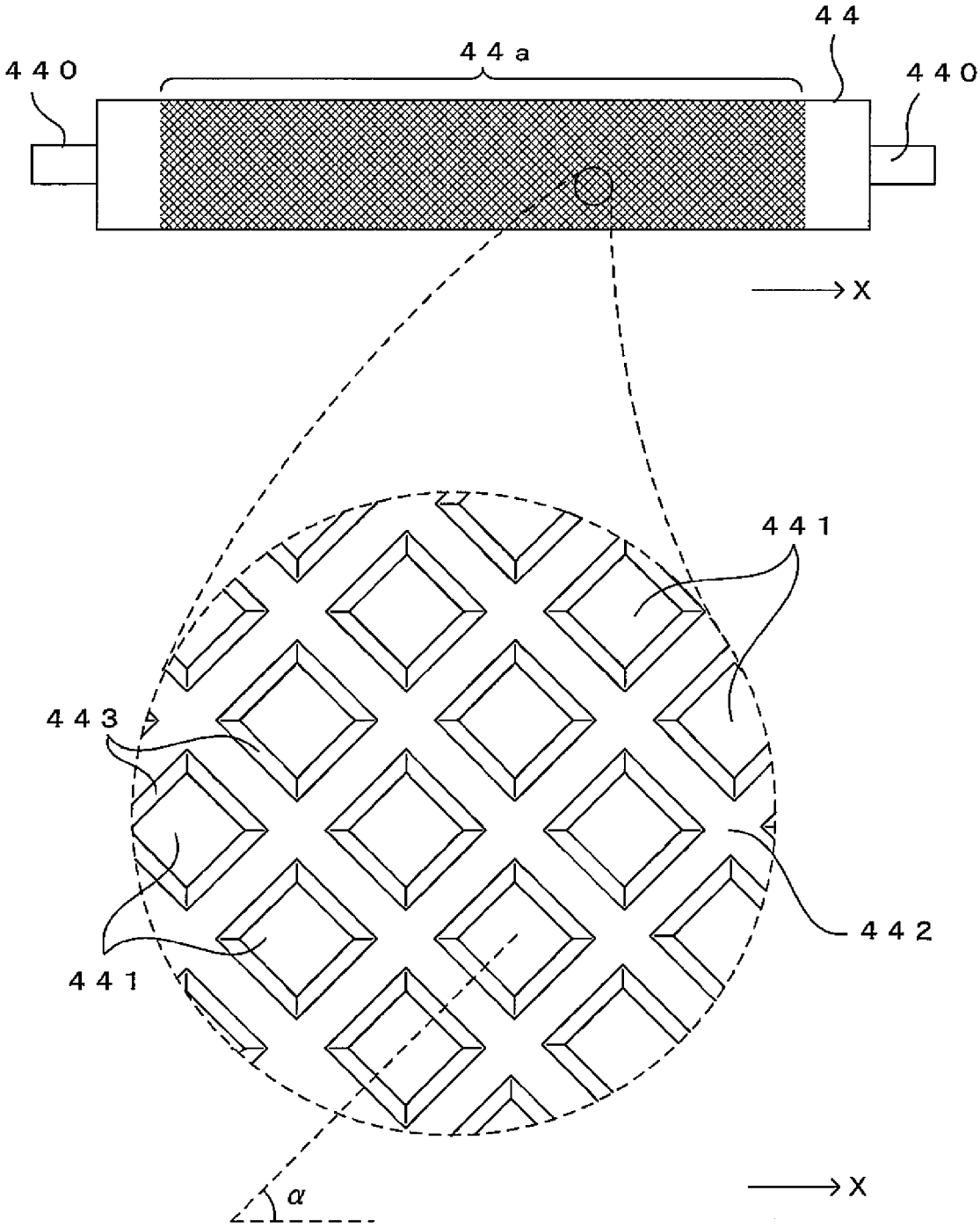
FIG. 5 is a group of diagrams showing a side view of the developing roller and a partially expanded view of the surface of the developing roller.

FIG. 5 is a group of diagrams showing a side view of the developing roller and a partially expanded view of the surface of the developing roller. The developing roller 44 is shaped like an approximately cylindrical roller. A shaft 440 is provided at the both ends of the roller in the longitudinal direction of the roller such that the shaft is coaxial with the roller. With the shaft 440 supported by the developer main body, the entire developing roller 44 is freely rotatable. A central area 44*a* in the surface of the developing roller 44, as shown in the partially expanded view in FIG. 5 (inside the dotted-line circle), is provided with a plurality of convex sections 441 which are regularly arranged and a concave section 442 which surrounds the convex sections 441.

Each one of the convex sections 441 projects forward from the plane of FIG. 5, and a top surface of each convex section 441 forms a part of a single cylindrical surface which is coaxial with the rotational axis of the developing roller 44. The concave section 442 is a continuous groove which surrounds the convex sections 441 like a net. The entire concave section 442 also forms a single cylindrical surface which is different from the cylindrical surface which is made by the convex sections and is coaxial with the rotational axis of the developing roller 44. Moderate slopes 443 connect the convex sections 441 to the concave section 442 which surrounds the convex sections 441. Specifically, a normal line to each slope 443 contains a component which is outward in a radial direction of the developing roller 44 (upward in FIG. 5), that is, a component in a direction away from the rotational axis of the developing roller 44. The developing roller 44 having such a structure may be made by the manufacturing method described in JP-A-2007-140080 for instance. An angle formed by a line extending in an oblique arrangement direction of the convex sections 441 and a line extending in the direction X is denoted at a as shown in FIG. 5 for later description.

Referring back to FIG. 1, the description of the image forming apparatus is continued. The toner image developed by the developer unit 4 as described above is primarily transferred onto an intermediate transfer belt 71 of a transfer unit 7 in a primary transfer region TR1. The transfer unit 7 includes the intermediate transfer belt 71 mounted on a plurality of rollers 72 to 75 and a driver (not shown) for driving the roller 73 into rotation to rotate the intermediate transfer belt 71 in a specified rotating direction D2. In the case of transferring a color image onto the sheet S, the toner images of the respective colors formed on the photosensitive member 22 are superimposed on the intermediate transfer belt 71 to form the color image, which is secondarily transferred onto the sheet S dispensed one by one from a cassette 8 and conveyed to a secondary transfer region TR2 along a conveyance path F.

At this time, for the purpose of correctly transferring the image on the intermediate transfer belt 71 onto the sheet S at a predetermined position, the timing of feeding the sheet S into the secondary transfer region TR2 is controlled. To be more specific, there is a gate roller 81 disposed in front of the secondary transfer region TR2 on the transportation path F. The gate roller 81 starts to rotate in accordance with the timing of rotation of the intermediate transfer belt 71, and accordingly, the sheet S is fed into the secondary transfer region TR2 at a predetermined timing.

Further, the sheet S on which the color image is thus formed is transported to a discharge tray 89 which is disposed at a top surface of the apparatus main body via a pre-discharge roller 82 and a discharge roller 83 after the toner image is fixed to the sheet S by a fixing unit 9. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. The sheet S is returned back to the transportation path F again before arriving at the gate roller 81. At this time, the surface of the sheet S which abuts on the intermediate transfer belt 71 in the secondary transfer region TR2 and is to receive a transferred image is opposite to the surface which already carries the image. In this fashion, it is possible to form images on the both surfaces of the sheet S.

Further, as shown in FIG. 2, the respective developers 4Y, 4C, 4M and 4K comprise memories 91, 92, 93 and 94 respectively which store data related to the production lot, the use history, the remaining toner amount and the like of the developers. In addition, wireless telecommunication devices 49Y, 49C, 49M and 49K are provided in the developers 4Y, 4C, 4M and 4K, respectively. When necessary, the telecommunication devices selectively perform non-contact data telecommunication with a wireless telecommunication device 109 which is provided in the apparatus main body, whereby data transmission between the CPU 101 and the memories 91 through 94 via the interface 105 is performed to manage various types of information regarding the developers such as management of consumables. Meanwhile, in this image forming apparatus, non-contact data transmission using electro-magnetic scheme such as wireless telecommunication is performed. However, the apparatus main body and each developer may be provided with connectors and the like, and the connectors may be engaged mechanically to perform data transmission between each other.

Further, as shown in FIG. 2, the apparatus includes a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, and the like in accordance with the control command from the CPU 111.

In FIG. 2, a reference numeral 113 represents an image memory provided in the main controller 11 in order to store the image supplied from the external apparatus, such as a host computer, via the interface 112. A reference numeral 106 represents a ROM for storage of an operation program executed by the CPU 101 and control data used for controlling the engine EG. A reference numeral 107 represents a RAM for temporary storage of operation results given by the CPU 101 and other data.

Further, there is a cleaner 76 in the vicinity of the roller 75. The cleaner 76 moves nearer to and away from the roller 75 driven by an electromagnetic clutch not shown. In a condition that the cleaner 76 is moved nearer to the roller 75, a blade of the cleaner 76 abuts on the surface of the intermediate transfer belt 71 mounted on the roller 75 and scrapes off the toner remaining on and adhering to the outer circumferential surface of the intermediate transfer belt 71 after the secondary transfer.

Furthermore, a density sensor 60 is disposed in the vicinity of the roller 75. The density sensor 60 confronts a surface of the intermediate transfer belt 71 and measures, as needed, the density of the toner image formed on the outer circumferential surface of the intermediate transfer belt 71. Based on the measurement results, the apparatus adjusts the operating conditions of the individual parts thereof that affects the image quality such as the developing bias applied to each developer, the intensity of the exposure beam L, and tone-correction characteristics of the apparatus, for example.

The density sensor 60 is structured to output a signal corresponding to a contrasting density of a region of a predetermined area defined on the intermediate transfer belt 71 using a reflective optical sensor, for example. The CPU 101 is adapted to detect image densities of individual parts of the toner image on the intermediate transfer belt 71 by periodically sampling the output signals from the density sensor 60 while moving the intermediate transfer belt 71 in rotation.

Restriction of a toner layer on the developing roller 44 within the developer 4K, . . . of the image forming apparatus having the structure above will now be described in detail. In a structure as that described above in which the surface of the developing roller 44 for carrying toner has concavity and convexity, it is possible for both the convex sections 441 and the concave section 442 of the developing roller 44 to carry toner. However, in this image forming apparatus, it is structured that the restriction blade 46 abuts on the developing roller 44 within the surface of the developing roller 44 directly to remove toner on the convex sections 441. The reason is as described below.

First, the distance between the restriction blade 46 and the convex sections 441 needs be controlled precisely in order to form a uniform toner layer on the convex sections 441. However, for carrying of toner only by the concave section 442, the restriction blade 46 may abut on the convex sections 441 and remove all toner on the convex sections 441, which can be realized relatively easily. Further, since the volume of the space defined between the restriction blade 46 and the concave section 442 determines the amount of transported toner, it is possible to stabilize a transported toner amount.

This provides another advantage with respect to superiority of a transported toner layer. That is, carrying of toner by the convex sections 441 tends to degrade toner because of friction contact of the toner with the restriction blade 46. More specifically, there are problems such as reduction of the fluidity and the charging performance of toner, clumping together due to toner particles pressed to each other, and filming due to fixedly adherence of toner to the developing roller 44. In contrast, carrying of toner by the concave section 442 which is less influenced by the pressure from the restriction blade 46 is less likely to give rise to such problems. Further, the manner of friction contact on the restriction blade 46 is greatly different between toner carried by the convex sections 441 and toner carried by the concave section 442. Hence, their charge levels are predicted to largely vary from each other However, carrying of toner by the concave section 442 alone makes it possible to suppress such variations.

The recent years in particular have seen a growing demand for size reduction of toner particles and a lower fixing temperature to enhance the resolution of an image and reduce the amount of consumed toner and electric power consumption. The structure described above meets the demand. Small-particle toner generally has a high saturation charge level but gets charged slowly at the beginning, and hence, toner carried by the convex sections 441 tends to have a significantly higher charge level (get excessively charged) than toner carried by the concave section 442. A charge level difference thus created shows itself as a development history in an image. Further, with respect to toner having a low melting point, fixing of toner to each other and fixing of the toner to the developing roller 44 and the like could easily occur by the friction contact of toner with each other or with the developing roller 44. However, such a problem is less likely to occur where the structure described above is used in which only the concave section 442 carries toner.

Next, a problem of toner adhesion to the seal member 47 as a subject matter of the invention is studied. The above problems such as toner adhesion could occur not only to the restriction blade 46 and the developing roller 44, but also to the seal member 47. As shown in FIG. 4A, the seal member 47 is held in contact with the surface of the developing roller 44 in the trail direction. Such a construction is necessary in preventing the toner from scattering to the outside of the developer, which may, however, result in toner fixation to the developing roller 44 and the seal member 47 because the toner on the developing roller 44 is sandwiched between the developing roller 44 and the seal member 47 to be pressed by them.

Figure 6A:
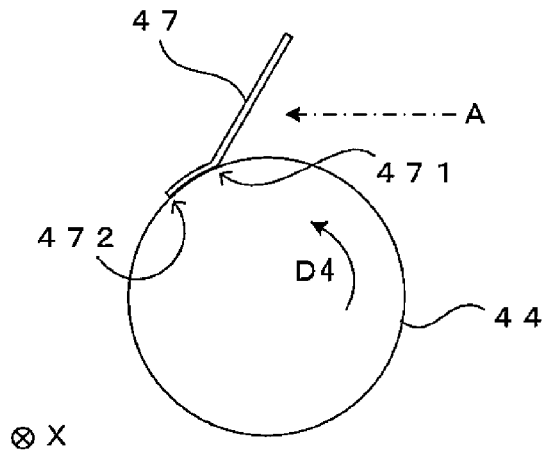
FIGS. 6A and 6B are diagrams showing a state of toner fixation in this apparatus.
Figure 6B:
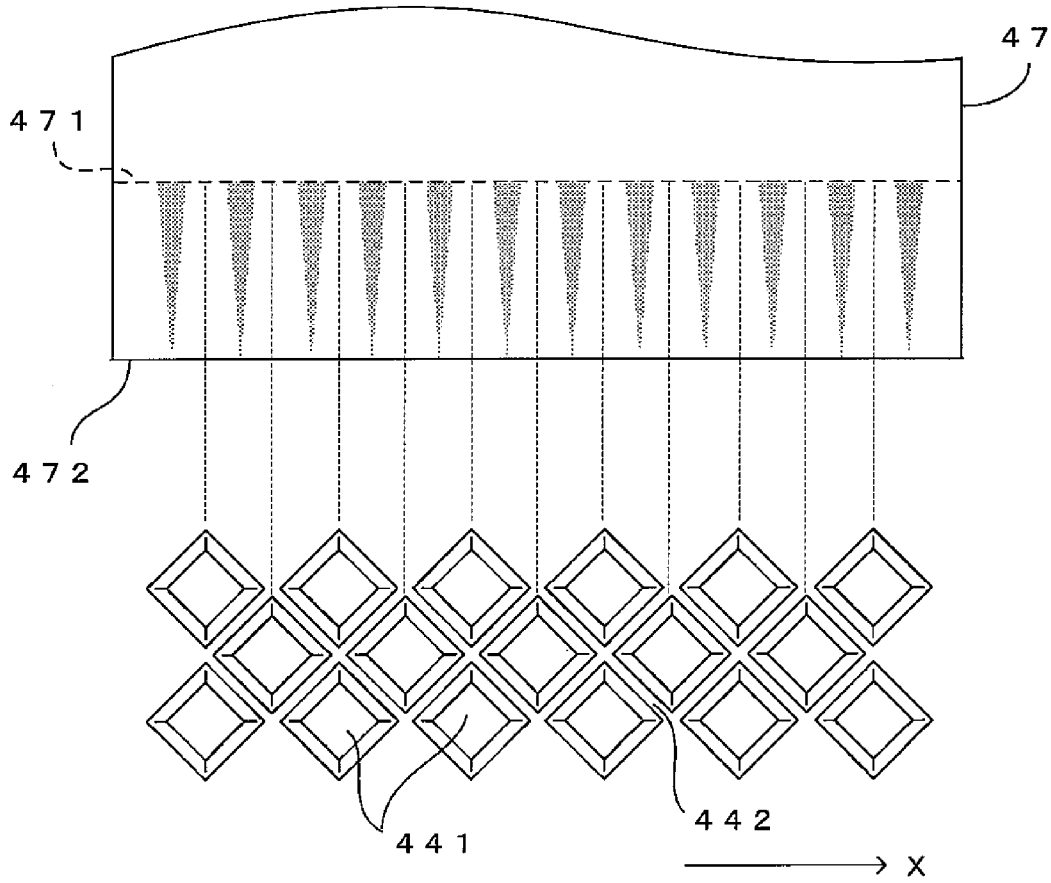

FIGS. 6A and 6B are diagrams showing a state of toner fixation in this apparatus. When the surface of the seal member 47 was observed in a direction of an arrow A shown in FIG. 6A, streaky toner fixation as if trailing from an upstream end 471 toward a downstream end 472 in the rotation direction D4 of the developing roller 44 was confirmed in a surface area of the seal member 47 held in contact with the developing roller 44 as shown in FIG. 6B. These streaks are aggregation or fusion of toner particles and additives separated from the toner particles on the seal member 47. These streaks cyclically appear in an axial direction (X direction) and this cycle is correlated with the arrangement pitch of the convex sections 441 on the surface of the developing roller 44. From this fact, this phenomenon can be described using the following model.

Figure 7A:
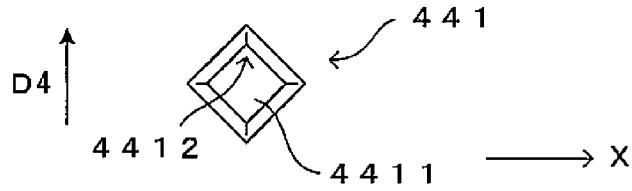
FIGS. 7A and 7B are diagrams showing a toner fixation model.
Figure 7B:
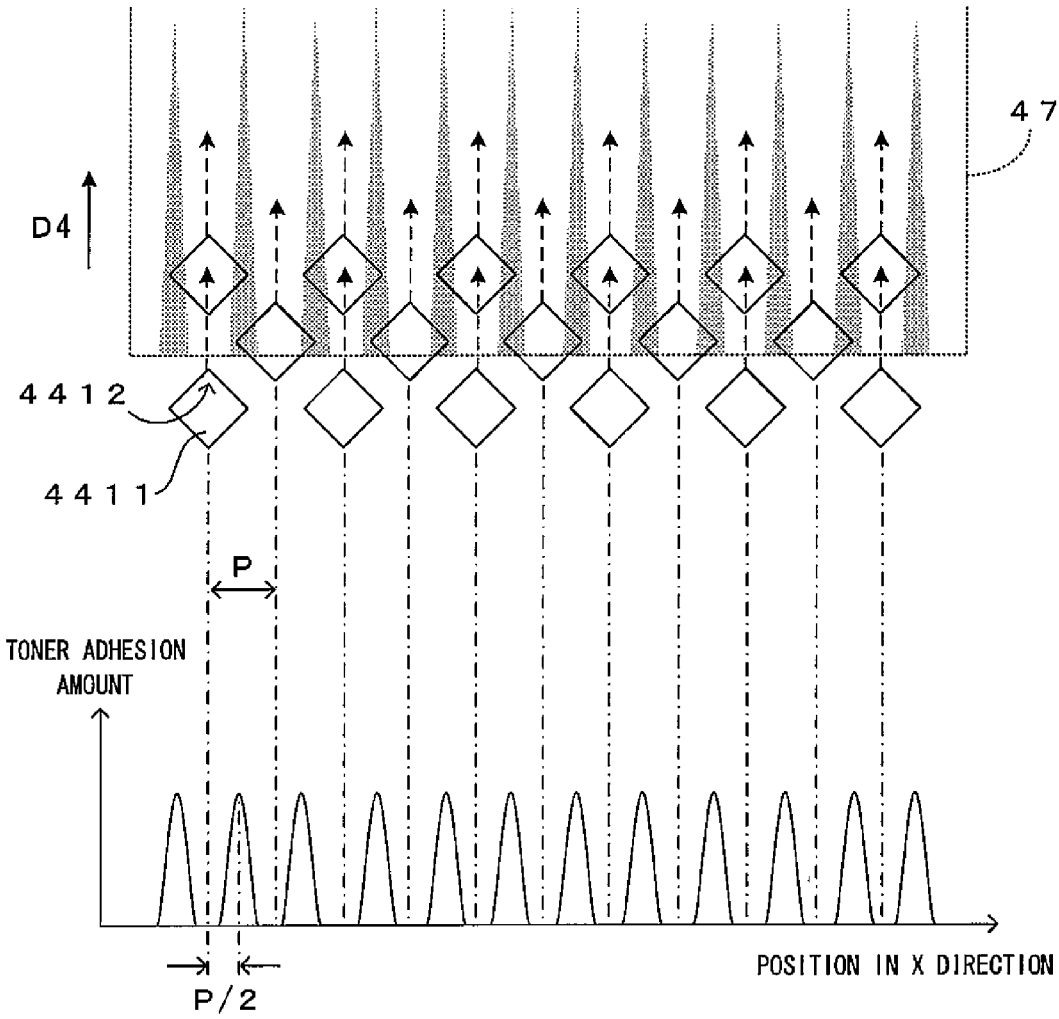

FIGS. 7A and 7B are diagrams showing a toner fixation model. As shown in FIG. 7A, each convex section 441 provided on the surface of the developing roller 44 has a substantially rhombic shape having a diagonal in the rotation direction D4 of the developing roller 44 and has a top surface 4411 forming a part of the cylindrical surface as described above. When the top surface 4411 is moved in the arrow direction D4 by the rotation of the developing roller 44, a peaked portion 4412 first comes into contact with the seal member 47. Such a pointed peaked portion 4412 acts to scrape off the toner adhering to the seal member 47 and the scraped-off toner is thought to be pushed to left and right along ridge lines of the convex section 441.

Since the top surfaces 4411 of the convex sections are regularly arranged in the axial direction (X direction) and in the moving direction (circumferential direction) D4 of the developing roller 44 orthogonal thereto on this developing roller 44 as shown in FIG. 7B, positions of the surface of the seal member 47 where the peaked portions 4412 of the respective top surfaces 4411 are in contact and positions thereof where the peaked portions 4412 are not in contact alternately appear in the X direction. Thus, the adhering toner is effectively removed at the positions in contact with the peaked portions 4412, whereas a toner removing effect is marginal and the toner removed from the surrounding flows in at the positions not in contact with the peaked portions 4412. As a result, streaky cyclical toner fixation appears on the surface of the seal member.

The arrangement pitch of the convex sections 441 in the axial direction is indicated by P. The arrangement pitch here does not indicate a pitch between adjacent ones of the respective convex sections aligned in the axial direction, but indicates a distance in the axial direction between the convex sections belonging to the adjacent rows as shown in FIG. 7B. The toner adhesion on the seal member 47 also occurs at the same pitch P, but a toner adhesion amount is minimized at the positions corresponding to the respective peaked portions 4412 while being maximized at positions corresponding to midpoints of these positions. In other words, on the seal member 47, the toner adhesion amount is maximized at positions displaced from the positions corresponding to the peaked portions 4412 by (P/2) in the axial direction.

Figure 8A:
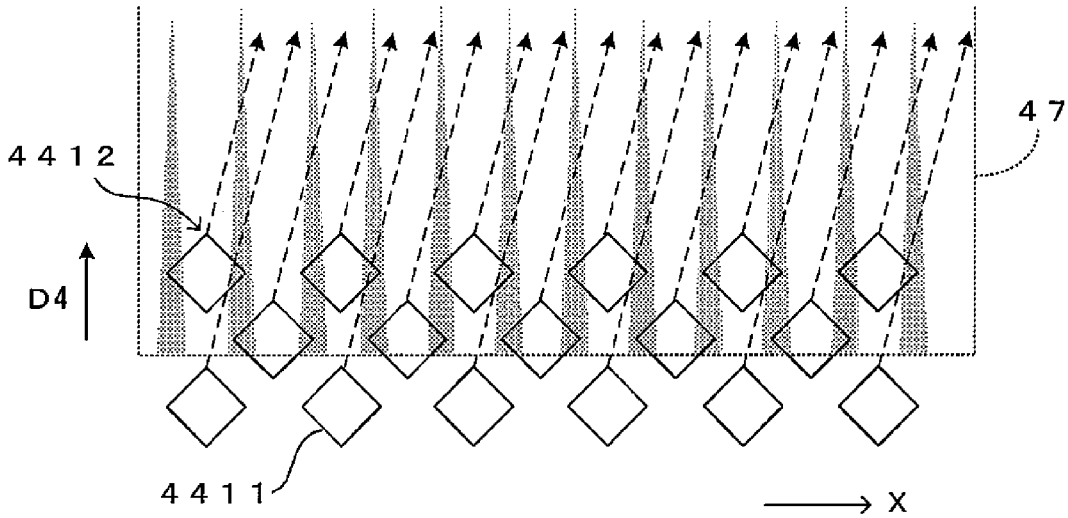
FIGS. 8A and 8B are diagrams showing basic principles of solving the toner fixation.
Figure 8B:
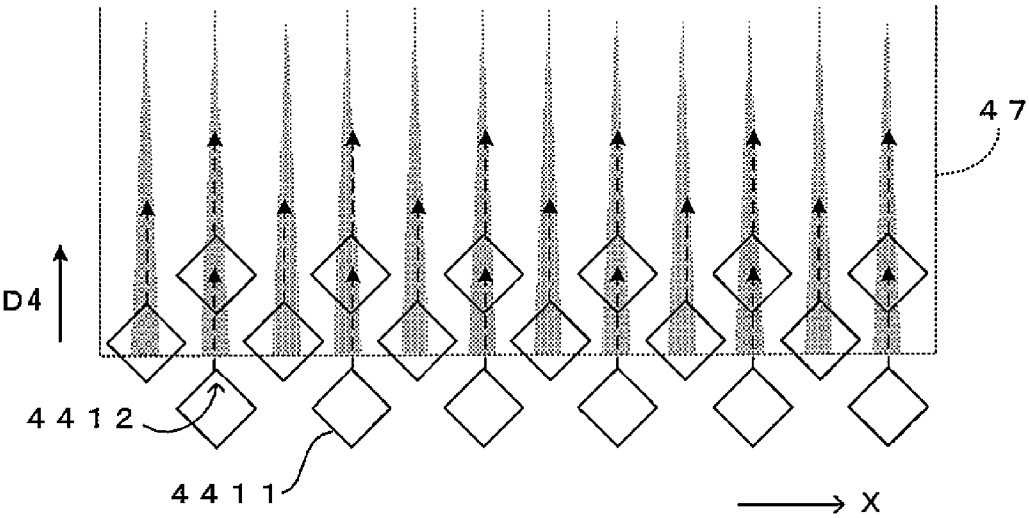

FIGS. 8A and 8B are diagrams showing basic principles of solving the toner fixation. In order to solve the toner fixation cyclically occurring on the seal member 47 as described above, it is, for example, thought to relatively move the developing roller 44 and the seal member 47 such that the respective peaked portions 4412 on the developing roller 44 cross the streaks formed on the seal member 47 by the toner fixation as shown by broken-line arrows of FIG. 8A. By doing so, the peaked portions 4412 of the convex sections provided on the developing roller 44 are expected to scrape off the fixed toner. Such movements can be realized by relatively moving the developing roller 44 and the seal member 47 in the axial direction while rotating the developing roller 44 in the direction D4 with the developing roller 44 and the seal member 47 held in contact. First and second embodiments of the invention described below are designed to solve the toner fixation based on this principle.

As another method for solving the toner fixation, it is also thought to rotate the developing roller 44 with the peaked portions 4412 of the convex sections held in contact with the streaks on the seal member 47 formed by the toner fixation as shown by broken-line arrows of FIG. 8B. By doing so, the peaked portions 4412 are expected to scrape off the fixed toner. Such movements can be obtained by rotating the developing roller 44 while relatively moving the developing roller 44 and the seal member 47 in the axial direction. Third and fourth embodiments of the invention described below are designed to solve the toner fixation based on this principle. The respective embodiments are described hereinafter.

Figure 9:
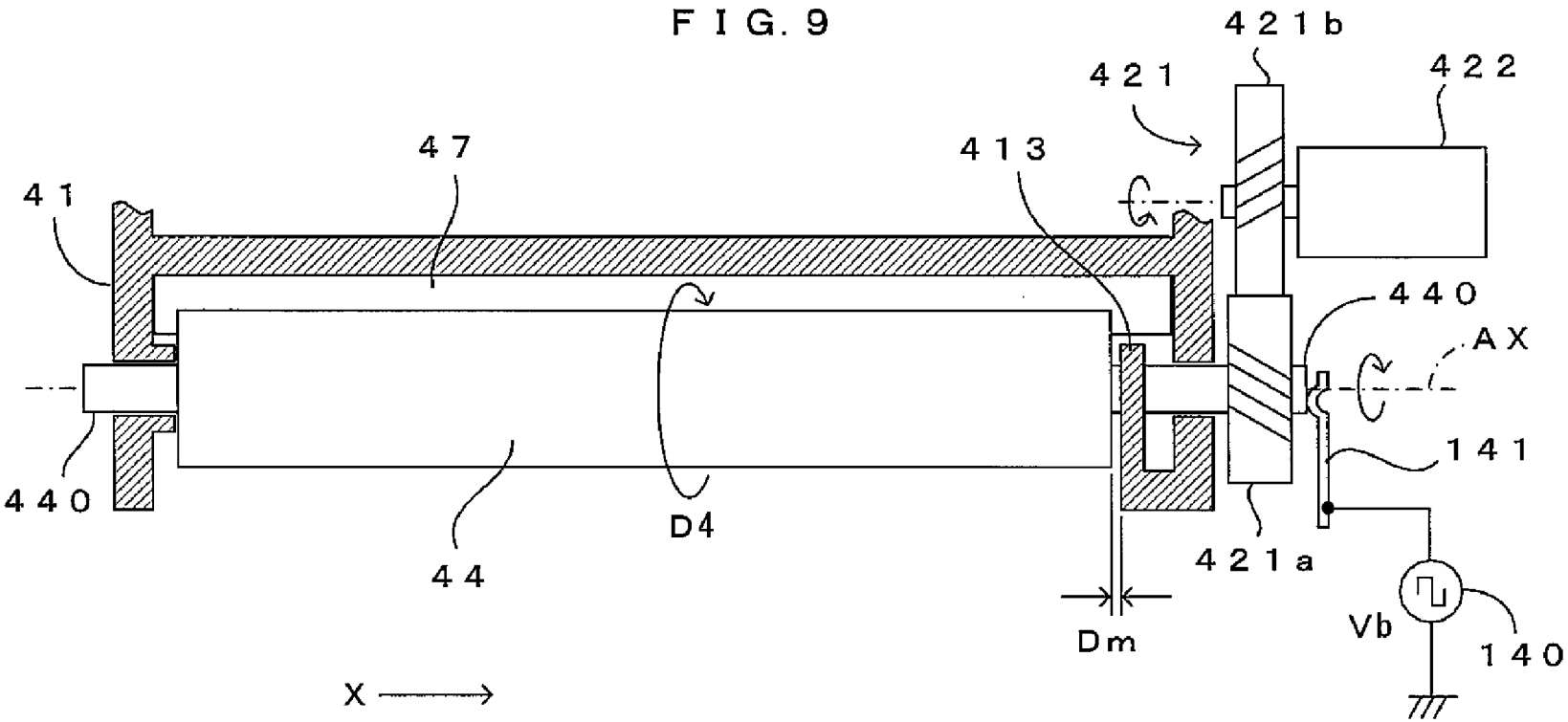
FIG. 9 is a diagram showing a driving mechanism for the developing roller according to the first embodiment.

FIG. 9 is a diagram showing a driving mechanism for the developing roller according to the first embodiment. The shaft 440 of the developing roller 44 is rotatably mounted in the housing 41 of the developer, and a gear 421*a* is fixed to one end thereof. This gear 421*a* is engaged with another gear 421*b* to form a gear pair 421. The gear 421*b* is connected with a motor 422. When the motor 422 rotates in accordance with a control command from the CPU 101, its torque is transmitted to the shaft 440 via the gear pair 421, whereby the developing roller 44 is rotated in the specified rotation direction D4.

The gear 421*b* and the motor 422 are not installed in the developer 4K or the like, but are mounted on the apparatus main body. When the developer 4K is positioned at the developing position by the rotation of the rotary developer unit 4, the gear 421*b* of the apparatus main body is engaged with the gear 421*a* of the developer, whereby the developing roller 44 can be driven and rotated by the motor 422 of the apparatus main body.

An electrode plate 141 made of an elastic conductive plate such as phosphor bronze or stainless steel is pressed into contact with an end surface of the shaft 440. This electrode plate 141 is connected with the bias power source 140, and a development bias voltage Vb outputted from the bias power source 140 is applied to the developing roller 44 via the electrode plate 141 and the shaft 440.

The electrode plate 141 also has a function of biasing the shaft 440 in a (−X) direction, that is, leftward in FIG. 9 by its elasticity. By this elastic force, the developing roller 44 is biased in the (−X) direction, that is, leftward in FIG. 9 when the developing roller 44 is in a stationary state.

The gear pair 421 is helical gears and so constructed as to thrust the shaft 440 in the X direction when the motor 422 rotates. Thus, when the motor 422 rotates, a force trying to displace the developing roller 44 in the X direction (rightward in FIG. 9) is exerted against the biasing force of the electrode plate 141 together with the torque. In other words, according to this construction, when a driving force of the motor 422 is given to the gear 421a to rotate the developing roller 44, the developing roller 44 is gradually displaced in the X direction while increasing the rotation speed. When the rotation is stopped, the rotation speed decreases and the developing roller 44 is displaced in the (−X) direction.

A restricting portion 413 for restricting a rightward movement amount of the developing roller 44 according to the rotation projects from the housing 41, and a gap between the end surface of the developing roller 44 and the restricting portion 413 is kept at a value Dm with the developing roller 44 held stationary. In this way, the maximum value Dm of the displacement amount of the developing roller 44 caused by the thrust is restricted by the restricting portion 413.

Figure 10:
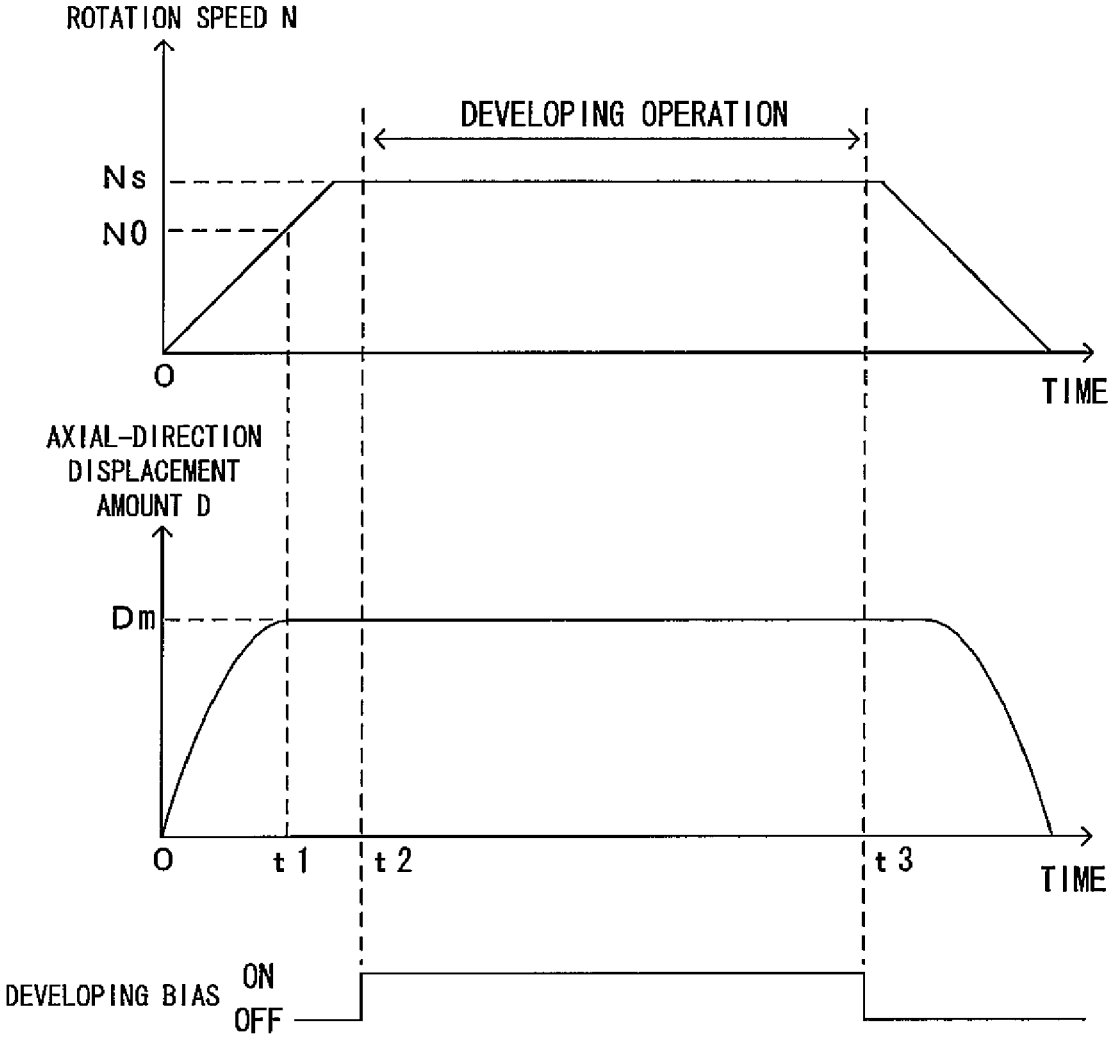
FIG. 10 is a graph showing a relationship between the rotation speed and the axial-direction displacement amount of the developing roller.

FIG. 10 is a graph showing a relationship between the rotation speed and the axial-direction displacement amount of the developing roller As a rotation speed N of the developing roller 44 is gradually increased by rotating the motor 422, the developing roller 44 is displaced in the X direction to increase an axial-direction displacement amount D. At time t1 at which the end surface of the developing roller 44 is in contact with the restricting portion 413, the displacement amount D does not increase any further. The value of the displacement amount at this time is Dm. The rotation speed at this time is shown by N0.

The rotation speed of the developing roller 44 is kept at a constant speed Ns during a period (from t2 to t3) of a developing operation for developing an electrostatic latent image on the photosensitive member 22 by applying a development bias voltage to the developing roller 44. By doing so, a variation of the image density can be prevented by maintaining the amount of the toner conveyed to an opposed position facing the photosensitive member 22 at a constant level. Further, the rotation speed Ns at this time has a value larger than the rotation speed N0 at which the displacement amount stops increasing. By doing so, it can be prevented that a variation of the rotation speed during the developing operation leads to a variation of the axial-direction displacement amount. When the developing operation is completed, the rotation of the developing roller 44 is stopped. As the rotation speed N decreases, the axial-direction displacement amount D of the developing roller 44 also gradually decreases.

As described above, in this embodiment, the developing roller 44 is displaced in the axial direction during an acceleration period lasting until the rotation speed reaches the constant speed Ns from the stationary state of the developing roller 44 and a deceleration period lasting until the developing roller 44 stops from the rotational state at the constant speed Ns. In this way, relative movement is made in an oblique direction as shown in FIG. 8A between each of the peaked portions 4412 of the convex sections 441 provided on the developing roller 44 and the seal member 47, with the result that the fixed toner on the surface of the seal member 47 is removed by being scraped off by the peaked portions 4412. As described above, in this embodiment, the toner fixation on the surface of the seal member 47 can be solved by displacing the developing roller 44 in the axial direction during the acceleration period and the deceleration period of the developing roller 44. Therefore, toner leakage, filming and the like resulting from the toner fixation can be prevented.

Since such a displacement of the developing roller 44 is realized by the thrust produced by the gear pair 421 for rotationally driving the developing roller 44 and the biasing force produced by the elasticity of the electrode plate 141 for applying the development bias voltage Vb to the developing roller 44, the toner fixation on the surface of the seal member 47 can be effectively solved by a simple apparatus construction without requiring a new construction for displacement.

Further, since the fixed toner is removed every time the developing roller 44 is accelerated and decelerated, the toner can be removed before being strongly fixed to the surface of the seal member 47. There are absolutely no adverse effects such as a reduction in the throughput of the developing operation and bad influence on image quality.

It is preferable not to apply the development bias voltage to the developing roller 44 during the acceleration and deceleration of the developing roller 44 as shown in FIG. 10. This is for the following reason. In this embodiment, the toner is carried only in the concave section 442 on the surface of the developing roller 44. When the development bias voltage Vb is applied to the developing roller 44, the toner on the surface of the developing roller 44 jumps across a development gap formed at the opposed position facing the photosensitive member 22. As a result, a part of the toner returning to the surface of the developing roller 44 after passing the development gap may adhere to the convex sections 441. Such toner carried on the convex sections 441 may possibly become new fixed toner by being pressed by the seal member 47. Further, the toner may possibly reduce the scraping-off effect by covering the peaked portions 4412. In order to effectively scrape off the toner by preventing these, it is preferable that no toner is present on the convex sections 441 and, for this purpose, it is effective not to apply the development bias.

The maximum displacement amount Dm in the axial direction of the developing roller 44 during the acceleration and the deceleration is described. For the purpose of solving the streaky toner fixation formed on the seal member 47 during the developing operation, the maximum displacement amount Dm needs to be, in principle, equal to or larger than half the arrangement pitch of the convex sections 441, that is, equal to or larger than (P/2). This is because the streaks by the toner fixation are formed at the positions displaced by (P/2) from the positions corresponding to the peaked portions 4412. In order to more reliably remove the toner, the maximum displacement amount Dm is preferably set equal to or larger than the arrangement pitch P of the convex sections 441. By doing so, the surface area of the seal member 47 held in contact with the developing roller 44 is substantially entirely made frictional contact by the peaked portions 4412. For example, when the arrangement pitch P of the convex sections 441 is 70 μm, the maximum displacement amount Dm of the developing roller 44 can be set to about 100 μm.

Figure 11A:
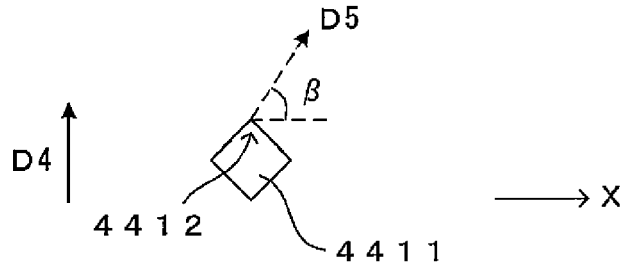
FIGS. 11A and 11B are diagrams showing a relationship between the rotation speed and a displacement speed of the developing roller.
Figure 11B:
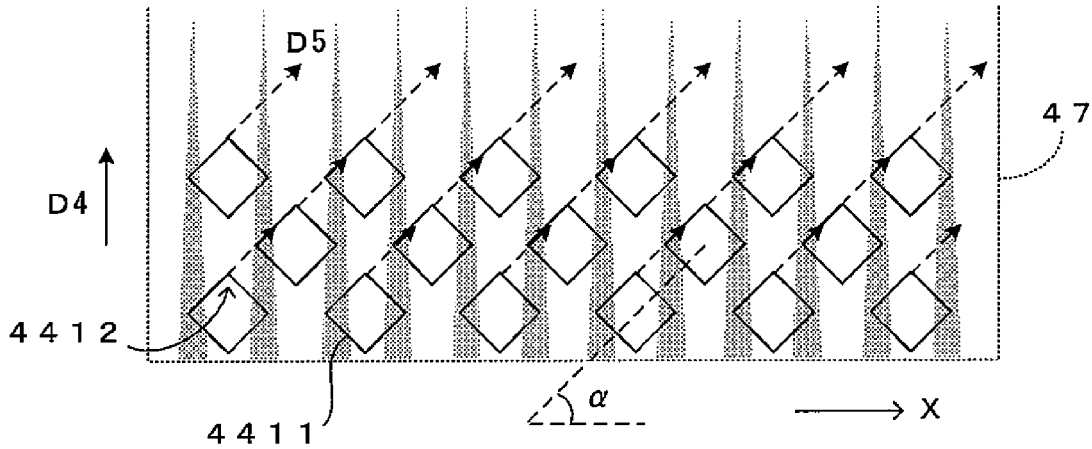

FIGS. 11A and 11B are diagrams showing a relationship between the rotation speed and a displacement speed of the developing roller. The displacement speed of the developing roller 44 in the axial direction is preferably slower than the moving speed of the surface of the developing roller 44 in the circumferential direction. Even with the same maximum displacement amount Dm, if the displacement amount D of the developing roller 44 reaches the maximum displacement amount Dm within a short period of time after the start of the rotation of the developing roller 44, a period during which the fixed toner on the seal member 47 is abraded by the peaked portions 4412 becomes shorter and a high removing effect cannot be obtained. In other words, when the moving direction of the peaked portion 4412 relative to the seal member is indicated by D5 as shown in FIG. 11A, an angle β formed by a line extending in the moving direction D5 and a line extending in the axial direction (X direction) is preferably as large as possible.

Particularly, it is not preferable that the moving direction D5 of the peaked portions 4412 coincides with an oblique arrangement direction of the convex sections 441 as shown in FIG. 11B. That is, it is not preferable that the angle β and the angle α (see FIG. 5) coincide as shown in FIG. 11B. In this case, paths of the respective peaked portions 4412 overlap each other and the scraping-off effect is restricted. However, in this embodiment, such a problem does not occur because the rotation speed is not constant since the developing roller 44 is displaced in the axial direction during the acceleration and the deceleration.

Next, the second embodiment of the image forming apparatus according to the invention is described. The construction of the apparatus according to this embodiment is exactly the sane as the above first embodiment. The apparatus of the second embodiment differs from the first embodiment in that a cleaning operation sequence is provided to more reliably scrape off toner fixed to the seal member 47.

Figure 12:
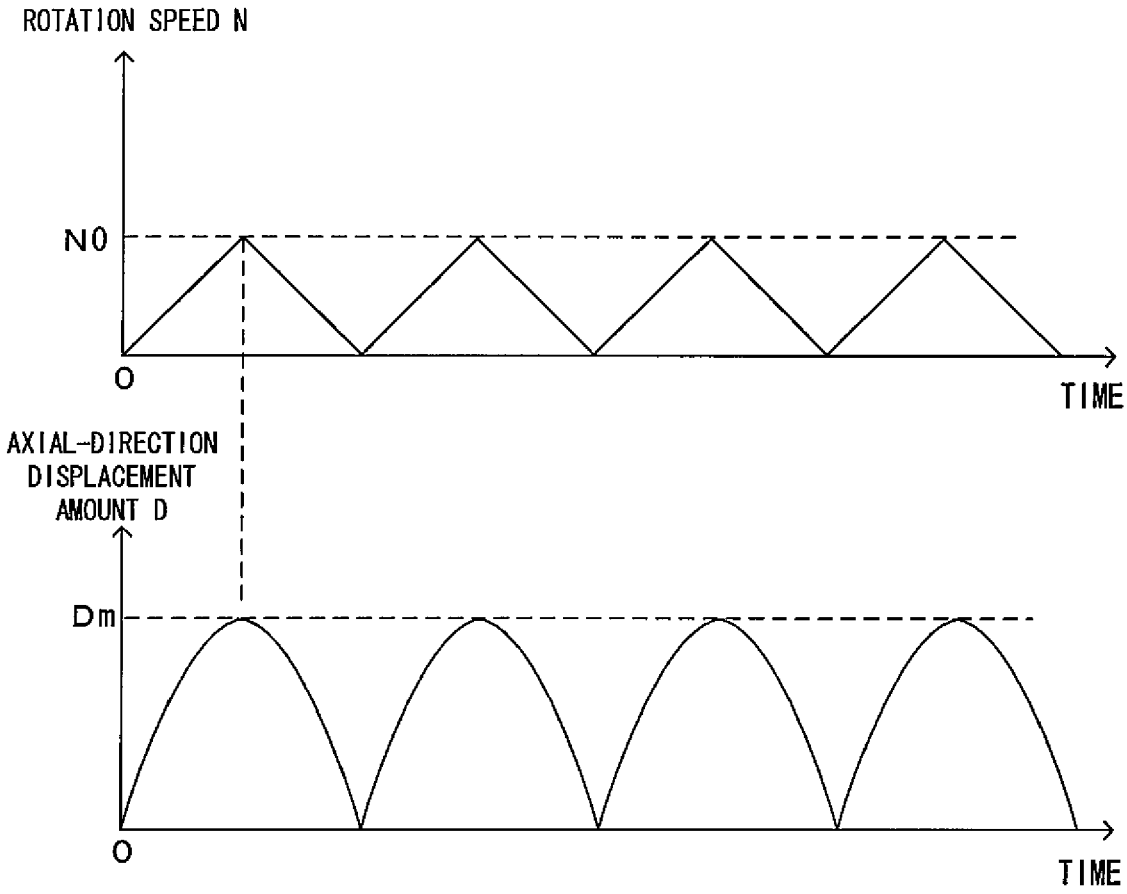
FIG. 12 is a graph showing a cleaning operation in the second embodiment.

FIG. 12 is a graph showing a cleaning operation in the second embodiment. As described above, by adopting the construction shown in FIG. 9 for the developer 4K, toner adhering to the seal member 47 can be removed by displacing the developing roller 44 in the axial direction during the acceleration and deceleration. In this embodiment, an effect of scraping off the toner on the seal member 47 is increased by repeating the acceleration and deceleration of the developing roller 44 to displace the developing roller 44 to left and right as shown in FIG. 12. During this time, no development bias voltage is applied to the developing roller 44.

In this operation, the upper limit of the rotation speed of the developing roller 44 is preferably equal to or slightly larger than the value N0. As shown in FIG. 10, the displacement amount of the developing roller 44 in the axial direction has the maximum value Dm at the rotation speed N0 and any further increase in the rotation speed is not advantageous in terms of the toner scraping-off effect since the displacement amount does not increase. Rather, the following adverse effects can be thought. Firstly, if the rotation speed is increased above N0, the displacement amount of the developing roller 44 no longer changes, wherefore the developing roller 44 is rotated without the relative positions of the developing roller 44 and the seal member 47 in the axial direction being changed. This causes the promotion of toner fixation to the seal member 47. Secondly, the rotation speed needs to be changed in a wide speed range, which increases a load on the motor 422.

Figure 13:
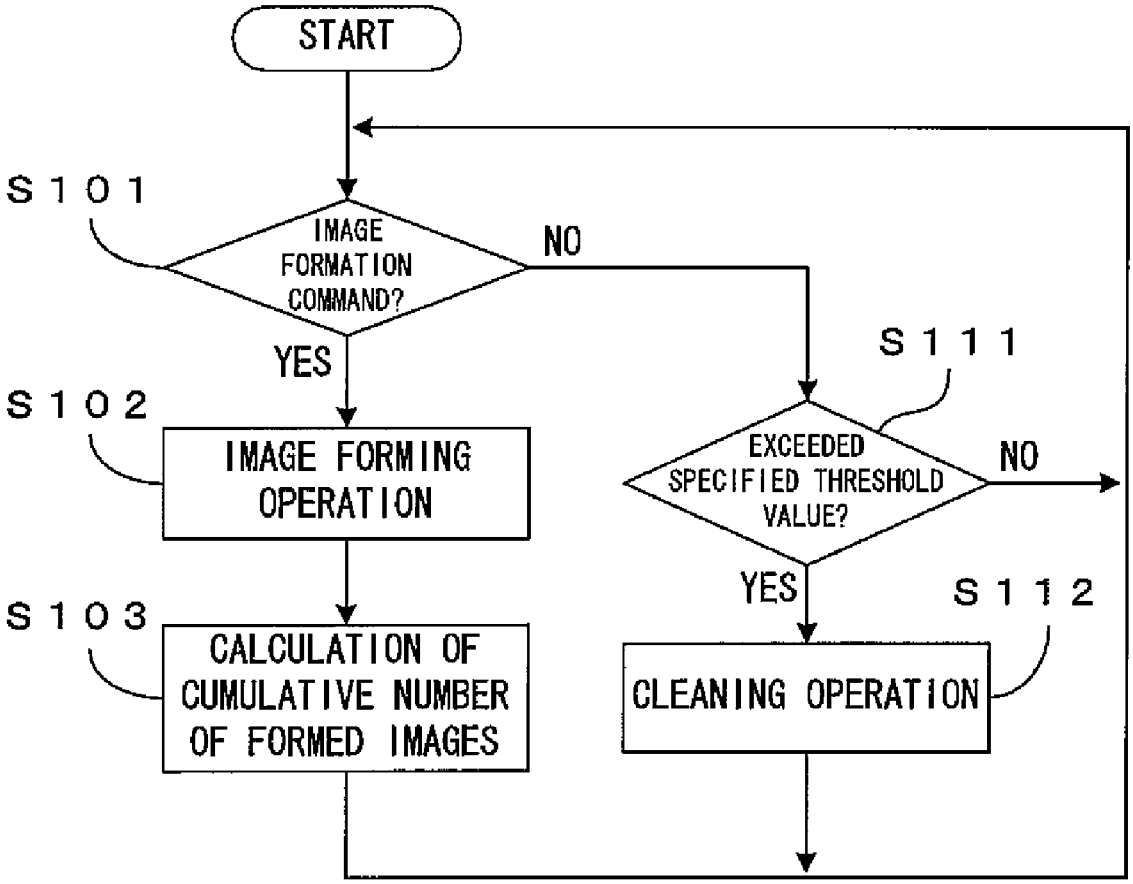
FIG. 13 is a flow chart showing an execution timing of the cleaning operation.

FIG. 13 is a flow chart showing an execution timing of the cleaning operation. Since the developing operation cannot be performed during the execution of the cleaning operation, the throughput of the developing operation is reduced if the cleaning operation is executed more than necessary. In order to prevent this, the following consideration is made in this embodiment.

When an image formation command is given to the apparatus from the outside (Step S101), the engine controller 10 controls the respective components of the engine part EG to perform an image forming operation, thereby forming an image corresponding to the command (Step S102). A cumulative number of images formed thus far using the presently mounted developer is calculated (Step S103) and this flow returns to Step S101. Here, the image forming operation is performed again if a new image formation command is given, whereas, if not so, whether or not the calculated cumulative image number has exceeded a specified threshold value is judged (Step S111). Here, a maximum number of images formable by each developer is set to 6000 and the threshold values are set in 1000s from 1000 to 5000.

Unless the image number has reached the threshold value, this flow returns to Step S101 and waits until a new image formation command is given. On the other hand, if the image number has exceeded the threshold value, the cleaning operation is successively executed (Step S112). As described above, this cleaning operation is an operation of repeating the acceleration and deceleration of the developing roller 44 up to the rotation speed N0 without applying any development bias voltage. When the cleaning operation is completed, this flow returns to Step S101 and waits until a new image formation command is given.

With this arrangement, the cleaning operation is performed every time the image number reaches 1000. In this way, the fixed toner, which could not be removed only by the frictional contact during the acceleration and deceleration, can be reliably removed. Since the cleaning operation is performed not immediately after the image number reaches the threshold value, but while no image formation command is given, there is no likelihood of reducing the throughput of image formation.

Next, the third and fourth embodiments of the image forming apparatus according to the invention are described. In the above first and second embodiments, the toner adhering to the surface of the seal member 47 is scraped off by displacing the developing roller 44 in the axial direction while rotating the developing roller 44. On the other hand, in the third and fourth embodiments described below, streaky toner fixation is solved by rotating the developing roller 44 in two rotation modes in which the relative positions of the developing roller 44 and the seal member 47 in the axial direction differ.

Figure 14A:
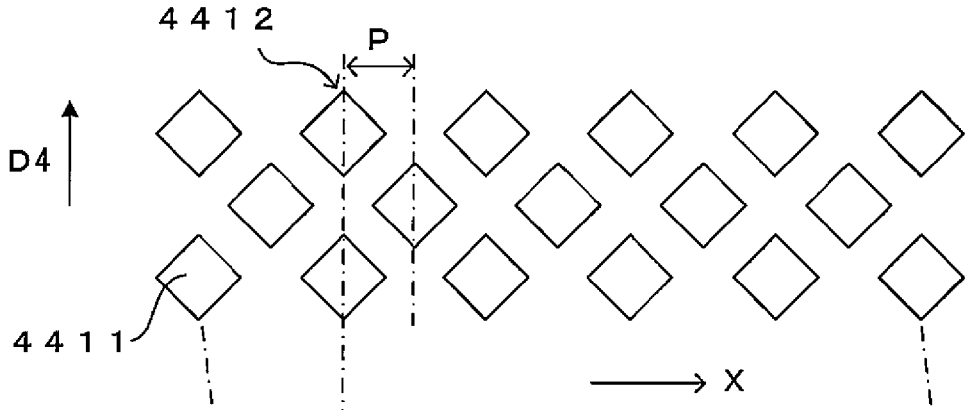
FIGS. 14A and 14B are diagrams showing the two rotation modes in the third and fourth embodiments.
Figure 14B:
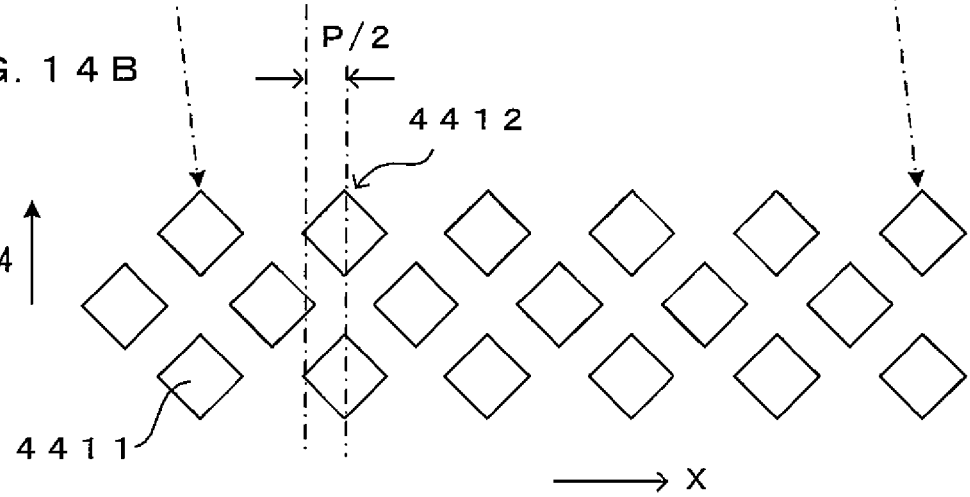

FIGS. 14A and 14B are diagrams showing the two rotation modes in the third and fourth embodiments. Between the first rotation mode shown in FIG. 14A and the second rotation mode shown in FIG. 14B, the positions of the respective peaked portions 4412 in the axial direction (X direction) are displaced by about half the arrangement pitch P of the convex sections. In order to realize this, the relative positions of the developing roller 44 and the seal member 47 may be changed by an odd number multiple of (P/2) between the two modes. By rotating the developing roller 44 in the two rotation modes thus set, the streaky toner fixation formed by one rotation mode can be solved by executing the other rotation mode.

Figure 15:
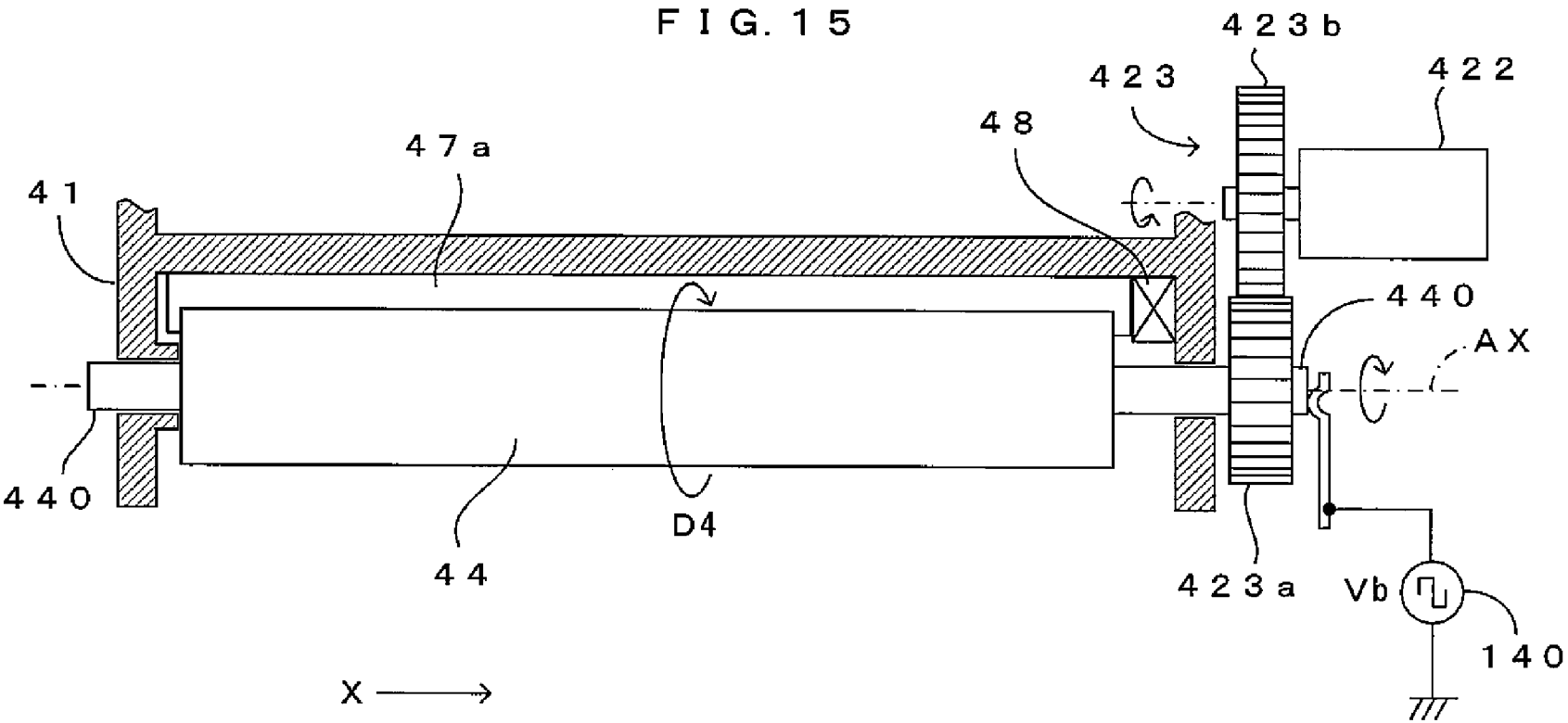
FIG. 15 is a diagram showing a driving mechanism for the developing roller in the third embodiment.

FIG. 15 is a diagram showing a driving mechanism for the developing roller in the third embodiment. In this embodiment, a gear pair 423 (423*a*, 423*b*) for transmitting a torque of the motor 422 to the shaft 440 of the developing roller 44 is comprised of spur gears. Thus, the shaft 440 is not thrust. On the other hand, instead of this, a seal member 47*a* is formed to be movable in the axial direction, and an actuator 48 controlled by the engine controller 10 to move the seal member 47*a* by a specified amount in the X direction is mounted at one end of the seal member 47*a*. Anything, for example, a piezoelectric element or a solenoid that can move the seal member 47*a* by the specified amount in the axial direction can be used as this actuator. In other words, in this embodiment, the developing roller 44 is not displaced in the axial direction and the seal member 47*a* is, instead, moved in the axial direction in accordance with a control command from the engine controller 10.

Figure 16:
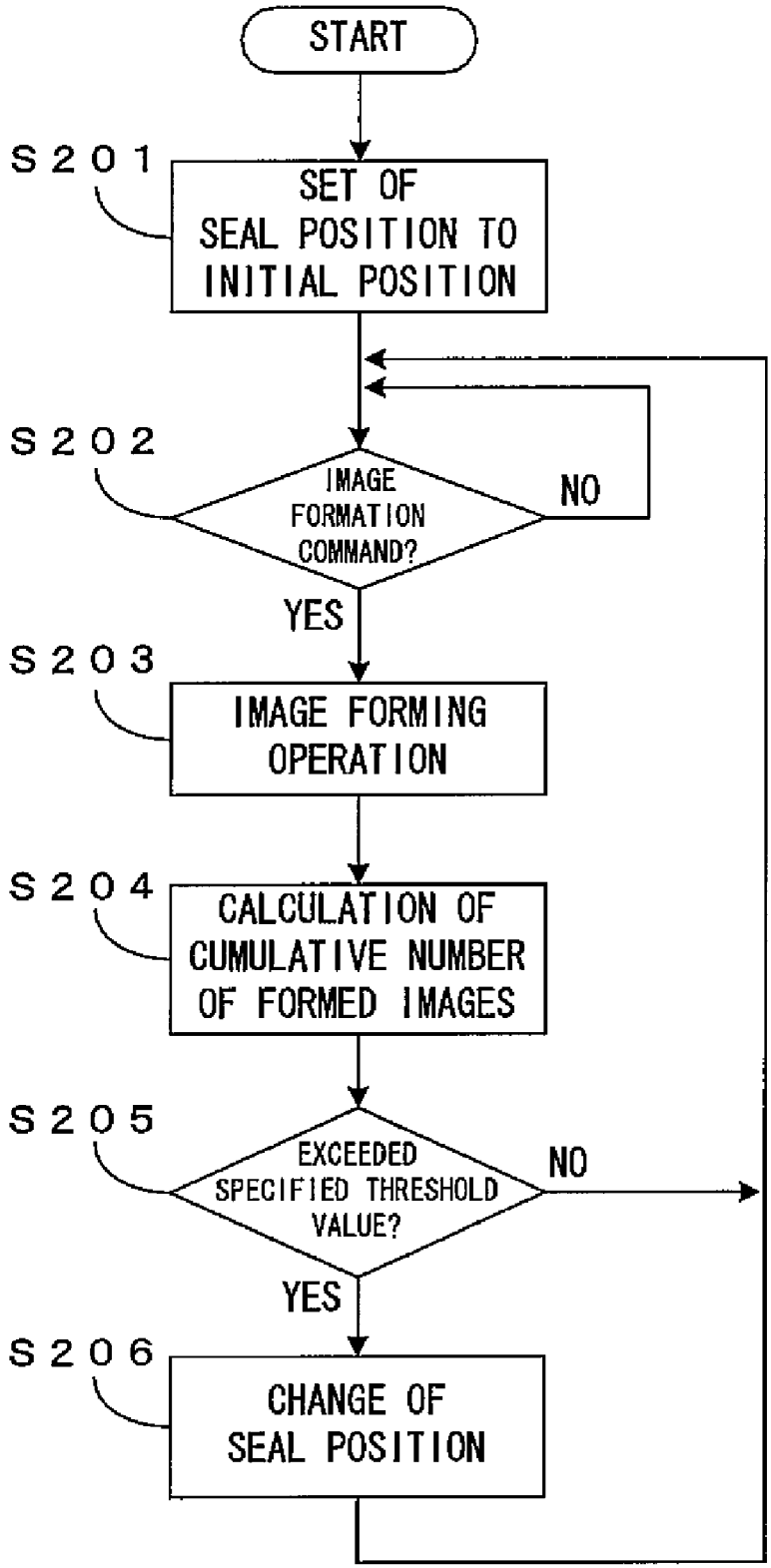
FIG. 16 is a flow chart showing the operation of the apparatus of the third embodiment.

FIG. 16 is a flow chart showing the operation of the apparatus of the third embodiment. In this embodiment, the position of the seal member 47*a* in the axial direction is first set to a specified initial position (Step S201). Then, it is waited until an image formation command is given from the outside (Step S202). If the image formation command is given, an image corresponding to this command is formed (Step S203) by performing an image forming operation while rotating the developing roller 44 (first rotation mode). Then, a cumulative image number as a cumulative number of images formed using this developer is calculated (Step S204).

Here, whether or not the cumulative image number has exceeded a specified threshold value is judged (Step S205). Threshold values here can be set, for example, in 100s, 500s or 1000s. Unless the cumulative image number has been reached, this flow returns to Step S202 to wait for a new image formation command. On the other hand, if the cumulative image number has exceeded the threshold value, the actuator 48 is controlled to change the position of the seal member 47*a* relative to the developing roller 44 in the axial direction (Step S206). A position change amount here is set to an odd number multiple of half the arrangement pitch P of the convex sections on the developing roller 44 as described above. If the arrangement pitch P is, for example, 70 μm, the position change amount of the seal member 47*a* can be, for example, set to 35 μm or 105 μm. Such a position movement hardly influences the operation of the apparatus.

After the position of the seal member 47*a* is changed in this way, this flow returns to Step S202 to repeat the above processing. Specifically, if a new image formation command comes, a corresponding image is formed (second rotation mode). If it is judged that the cumulative image number has exceeded the next threshold value (Step S205), the actuator 48 is controlled again to return the position of the seal member 47*a* in the axial direction to the initial position. By repeating this, the relative positions of the developing roller 44 and the seal member 47*a* are alternately changed between two positions every time a specified number of images are formed. At these two positions, the peaked portions 4412 on the surface of the developing roller 44 act to scrape off the streaky toner adhesion.

As described above, the two rotation modes in which the relative positions of the developing roller 44 and the seal member 47*a* in the axial direction differ only by the odd number multiple of half the arrangement pitch P of the convex sections 441 are provided as the rotation modes for rotating the developing roller 44 in this embodiment. Images are formed while these two rotation modes are switched every time a specified number of images are formed. By doing so, the cyclical toner fixation on the surface of the seal member 47*a*, which occurs in the case of image formation with the positions of the developing roller 44 and the seal member 47*a* in the axial direction fixed, can be solved. Therefore, toner leakage, filming or the like resulting from toner fixation can be prevented.

Since the position of the seal member 47*a* is switched between two image forming operations, the seal member 47*a* is not moved during the developing operation and there is no bad influence on image quality. Further, since the seal member 47*a* can be moved in a very short period of time by the actuator 48, the throughput of image formation is not reduced. The local abrasion of the seal member 47*a* can be suppressed by using the seal member 47*a* at two positions, wherefore a long life of the developer can be promoted.

Figure 17:
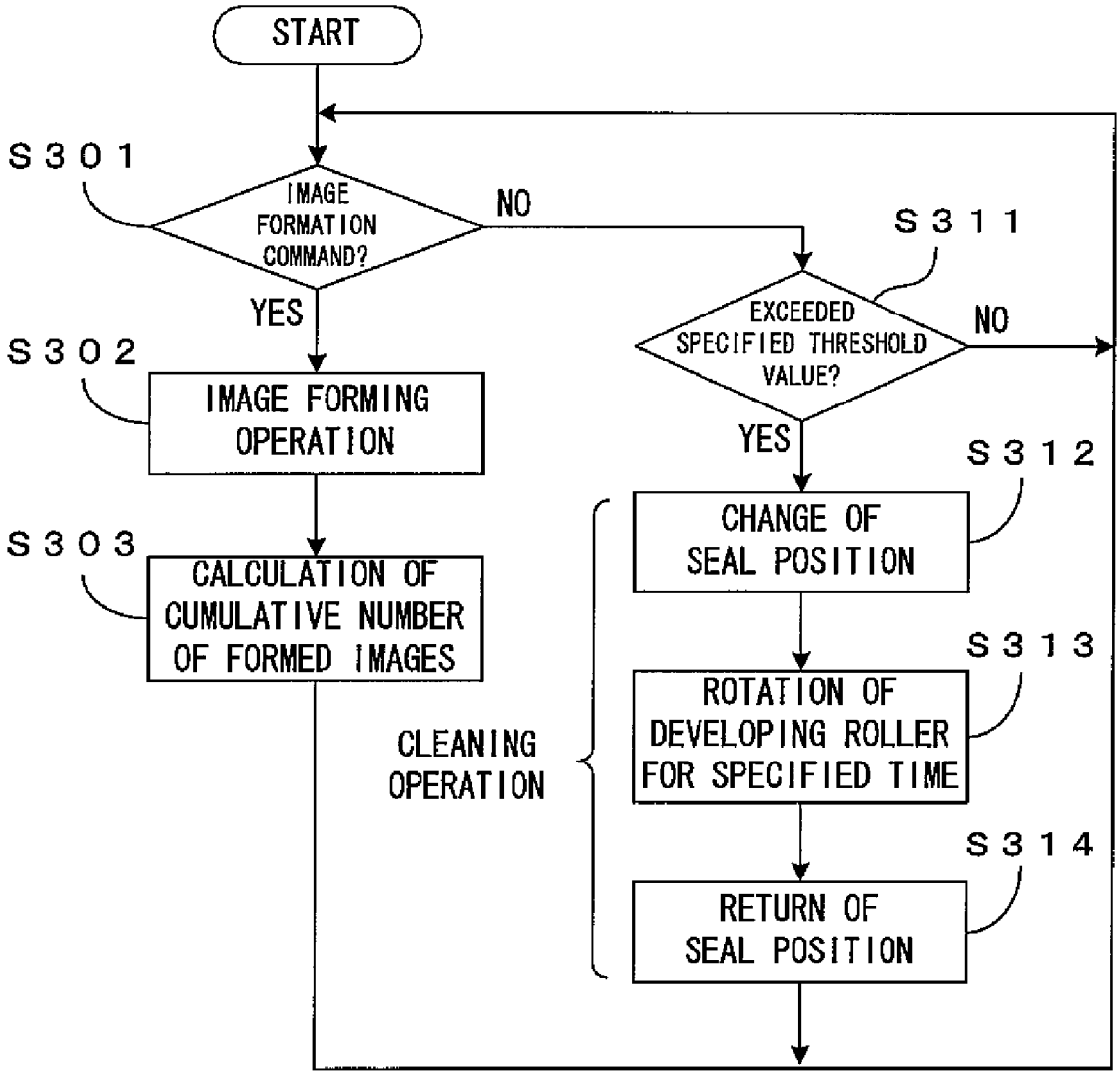
FIG. 17 is a flow chart showing the operation of the apparatus according to the fourth embodiment.

FIG. 17 is a flow chart showing the operation of the apparatus according to the fourth embodiment. In the above third embodiment, the developing operation of developing an electrostatic latent image is performed respectively in the two rotation modes with different positions of the seal member 47*a* in the axial direction. Instead, in the fourth embodiment described below, the developing operation is performed in one rotation mode using a developer (FIG. 15) with the same construction as in the third embodiment, whereas no developing operation is performed and only the cleaning operation is performed in the other rotation mode.

Specifically, in this embodiment, if an image formation command is given from the outside (Step S301), an image forming operation is performed to form an image corresponding to this command (Step S302) and a cumulative image number is calculated (Step S303). This flow then returns to Step S301 and the image forming operation is performed again in accordance with a new image formation command if there is any.

On the other hand, if no new image formation command is given, whether or not the cumulative image number has reached a specified threshold value (every time the 1000th image is formed, for instance) is judged (Step S311). Here, this flow returns to Step S301 again unless the threshold value has not been reached, but the position of the seal member 47*a* in the axial direction is changed by the actuator 48 as the cleaning operation (Step S312) in the case of exceeding the threshold value. In this state, a series of operations including the rotation of the developing roller 44 for a specified time without applying any development bias voltage (Step S313) and the return of the seal member 47*a* to the initial position (Step S314) are performed.

As described above, in this embodiment, one of the two rotation modes with different positions of the seal member 47*a* in the axial direction is used in the developing operation and the other is used in the cleaning operation. In this way as well, the toner fixation to the surface of the seal member 47*a* during the developing operation can be solved by performing the cleaning operation.

In this case, since the application of the development bias voltage to the developing roller 44 can be stopped in the cleaning operation, the peaked portions 4412 can be brought into contact with the seal member 47*a* without the toner being carried on the convex sections 441 on the surface of the developing roller 44. Therefore, a high toner scraping-off effect can be obtained. Since the relative positional relationship of the developing roller 44 and the seal member 47*a* in the developing operation is constantly the same, the width of the toner layer carried on the developing roller 44 in the axial direction can be, for example, set assuming only this positional relationship.

The invention is not limited to the above embodiments, and various changes other than the above can be made without departing from the gist thereof. For example, the developing roller 44 is moved in the axial direction in the above first and second embodiments, whereas the seal member 47*a* is moved in the axial direction in the third and fourth embodiments. The invention is not limited to these. According to the concept of the invention, it is important to change the relative positional relationship of the developing roller 44 and the seal member 47, 47*a* in the axial direction and it does not matter which one of the developing roller 44 and the seal member 47, 47*a* is moved or both of them may be moved. However, particularly in the case of moving the developing roller 44 in the axial direction, the developing roller 44 is moved relative to other members in contact with the developing roller 44, that is, the supply roller 43 and the restriction blade 46, wherefore it is also expected to solve the toner fixation to these members.

The mechanism for moving the developing roller 44 or the seal member 47, 47*a* is not limited to the above ones, either. For example, the developing roller 44 is displaced utilizing the thrust produced by the helical gears in the first and second embodiments, but bevel bears, screw gears or other gears that can thrust the shaft 440 may be used or the developing roller 44 may be displaced by the actuator.

Although the shaft 440 is biased in the (−X) direction utilizing the elasticity of the electrode plate 141 in the above first and second embodiments, an electrode for applying the development bias voltage to the developing roller and a construction for biasing the shaft may be individually provided.

The following cleaning operation may be performed by combining the second and fourth embodiments. Specifically, in the construction of FIG. 15, the seal member 47*a* is moved in the axial direction by the actuator 48 at a speed slower than the moving speed of the surface of the developing roller 44. By doing so, the scraping-off effect exhibited when the peaked portions 4412 of the convex sections obliquely cross the streaks of the fixed toner on the surface of the seal member 47*a* in the process of moving the seal member 47*a* and the scraping-off effect exhibited when the developing roller 44 is rotated for a specified time while the fixed toner is abraded by the peaked portions 4412 can be both obtained.

In the above respective embodiments, the invention is applied to the image forming apparatus employing a so-called rotary development method in which a plurality of developers are mounted in the rotating rotary developer unit. An application subject of the invention is not limited to this and the invention is also applicable, for example, to an image forming apparatus employing a so-called tandem development method in which a plurality of developers are arranged in a rotation direction of a transfer medium or to a monochromatic image forming apparatus including only one developer.

As described above, in the above respective embodiments, the photosensitive member 22, the developing roller 44 and the seal member 47, 47*a* respectively function as an "latent image carrier", a "toner carrier roller" and a "seal member" of the invention. Further, the motor 422, the gear pair 421, 423 and the electrode plate 141 respectively function as a "driver", a "gear pair" and a "biasing member" of the invention and function together as a "moving mechanism" of the invention. In the above third and fourth embodiments, the actuator 48 functions as the "moving mechanism" of the invention. The cleaning operation in these embodiments corresponds to a "removal operation" of the invention.

In an embodiment of the invention, the top surfaces of the plurality of convex sections may form parts of the same cylindrical surface and the top surface of each convex section may include a peaked portion projecting forward in the moving direction of the surface of the toner carrier roller. By forming the parts of the same cylindrical surface by the top surfaces of the convex sections, contact pressures become uniform on the respective convex sections when the respective convex sections come into contact with the seal member, wherefore local toner adhesion to the convex sections or the seal member resulting from a local increase of the contact pressures can be prevented. Further, the effect of scraping off the toner on the surface of the seal member by the convex sections can be increased by providing the respective convex sections with the peaked portions projecting toward the upstream side in the rotation direction of the toner carrier roller.

Further, a relative movement amount of the seal member and the toner carrier roller in the axial direction is preferably equal to or larger than half an arrangement pitch of the convex sections in the axial direction. Since the toner adheres to the seal member in a cycle corresponding to the arrangement pitch of the convex sections, such cyclical toner adhesion can be counteracted by setting the position change amount of the seal member and the toner carrier roller at least to half the arrangement pitch.

In a first mode as a more specific mode of the image forming apparatus according to this invention, two rotation modes in which relative positions of the seal member and the toner carrier roller in the axial direction differ by an odd number multiple of half the arrangement pitch are provided as rotation modes for rotating the toner carrier roller and these two rotation modes are executed in a switching manner. By doing so, positions with high toner scraping-off effect by the toner carrier roller and positions with low toner scraping-off effect appear at direct opposite positions on the seal member surface between the two rotation modes. Therefore, regular toner adhesions formed upon singly executing the respective rotation modes can be counteracted by each other.

In this first specific mode, an electrostatic latent image on the image carrier may be developed with toner carried on the toner carrier roller in the first one of the two rotation modes, whereas the convex sections of the toner carrier roller may be brought into contact with the toner adhering to the seal member without developing an electrostatic latent image in the second one of the two rotation modes. In such a construction, regular toner fixation caused by executing the first rotation mode for developing the electrostatic latent image can be solved by executing the second rotation mode. In order to increase the toner scraping-off effect, no toner is preferably carried on the convex sections in the second rotation mode.

The electrostatic latent image on the image carrier may be developed with toner carried on the toner carrier roller respectively in the two rotation modes. By doing so, the electrostatic latent image can be developed in either one of the two rotation modes and the regular toner fixation can be counteracted by executing the two rotation modes in a switching manner.

In a second specific mode of the image forming apparatus according to this invention, the toner carrier roller is relatively moved by a distance equal to or larger than half the arrangement pitch relative to the seal member while being rotated about the rotational axis. According to such a construction, the toner adhering to the surface of the seal member can be scraped off by the surface of the toner carrier roller by changing the relative positions of the toner carrier roller and the seal member in the axial direction with the toner carrier roller and the seal member held in contact. In this case as well, regular toner fixation can be counteracted by setting a relative movement amount of the toner carrier roller and the seal member equal to or larger than half the arrangement pitch of the convex sections.

In this mode, the relative movement amount of the toner carrier roller relative to the seal member is more preferably equal to or larger than the arrangement pitch. By doing so, the toner adhering to the seal member can be more reliably scraped off.

Further, the toner carrier roller may be relatively moved relative to the seal member at least during acceleration of the toner carrier roller until the rotation speed of the toner carrier roller reaches a specified constant speed from a stationary state or during deceleration of the toner carrier roller until the toner carrier roller reaches a stationary state from a rotational state at the constant speed. Upon developing the electrostatic latent image, it is preferable in obtaining a good image quality to rotate the toner carrier roller at a constant speed and not to move the relative position of the toner carrier roller relative to the seal member in the axial direction. On the other hand, since there is no such restriction during the acceleration and the deceleration of the toner carrier roller, the adhering toner can be removed without reducing the throughput of image formation when the toner adhering to the seal member is scraped off by relatively moving the toner carrier roller and the seal member during these periods.

A removal sequence may be executed to relatively reciprocate the toner carrier roller relative to the seal member in the axial direction. By doing so, the toner fixed to the seal member can be more reliably removed.

In order to realize such relative movements, there may be provided, for example, a driver for generating a driving force for rotating the toner carrier roller in a specified rotation direction, a gear pair having one gear connected with the driver and the other gear fixed to the toner carrier roller and adapted to transmit the driving force to the toner carrier roller and to thrust the toner carrier roller in the axial direction due to the driving force, and a biasing member for biasing the toner carrier roller in a direction opposite to a thrusting direction of the toner carrier roller due to the driving force, and the driver, the gear pair and the biasing member may constitute the moving mechanism.

According to such a construction, the position of the toner carrier roller in the axial direction is changed by a balance of the thrust produced by the gear pair and the biasing force by the biasing member. In other words, the toner carrier roller is biased toward one side in the axial direction by the biasing member while the toner carrier roller is not driven to rotate by the driver. Here, when the driving force from the driver is transmitted to the toner carrier roller via the gear pair, the toner carrier roller is thrust in the axial direction. Since this thrusting direction is opposite to the biasing direction by the biasing member, the toner carrier roller is moved in the axial direction. When the driving is stopped, the toner carrier roller is moved to the initial position by the biasing force of the biasing member. In this way, the toner carrier roller can be moved in the axial direction by a simple construction. This movement is advantageous also in not being made during the constant rotation of the toner carrier roller, but being made only during the acceleration and deceleration.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

a latent image carrier that carries an electrostatic latent image;

a housing that stores toner inside;

a toner carrier roller that is shaped approximately like a cylinder, is mounted to the housing rotatably about a rotational axis, rotates while carrying toner on a surface thereof to convey the toner to an opposed position facing the latent image carrier outside the housing, and is provided, on the surface thereof, with a plurality of convex sections which are regularly arranged in an axial direction parallel to the rotational axis and in a circumferential direction orthogonal to the axial direction and parallel to a circumferential surface of the toner carrier roller and a concave section which surrounds the convex sections;

a seal member that is arranged in abutting contact with the surface of the toner carrier roller moving from the outside the housing toward the inside the housing at a position downstream of the opposed position in a rotation direction of the toner carrier roller to prevent toner leakage from the inside the housing;

a moving mechanism that relatively moves the toner carrier roller relative to the seal member in the axial direction; and a controller that is adapted to control a rotation of the toner carrier roller by executing a predetermined rotation mode, has two rotation modes in which relative positions of the seal member and the toner carrier roller in the axial direction differ by an odd number multiple of half the arrangement pitch, and selectively executes either one of the two rotation modes, wherein the convex sections are arranged in the axial direction at a specified arrangement pitch, and a relative movement amount of the toner carrier roller relative to the seal member in the axial direction by the moving mechanism is equal to or larger than half the arrangement pitch.

2. The image forming apparatus according to claim 1, wherein the convex sections include top surfaces that coincide with a part of a curved surface of a single cylinder and have peaked portions projecting forward in the rotation direction of the surface of the toner carrier roller.

3. The image forming apparatus according to claim 1, wherein the controller has a first rotation mode and a second rotation mode as the two rotation modes, the first rotation mode being a mode in which an electrostatic latent image on the latent image carrier is developed with toner carried on the toner carrier roller, the second rotation mode being a mode in which the convex sections of the toner carrier roller are brought into contact with the toner adhering to the seal member without developing any electrostatic latent image.

4. The image forming apparatus according to claim 1, wherein the toner carrier roller develops an electrostatic latent image on the latent image carrier with toner carried on the toner carrier roller in the respective two rotation modes.

5. An image forming apparatus comprising:

a latent image carrier that carries an electrostatic latent image;

a housing that stores toner inside;

a toner carrier roller that is shaped approximately like a cylinder, is mounted to the housing rotatably about a rotational axis, rotates while carrying toner on a surface thereof to convey the toner to an opposed position facing the latent image carrier outside the housing, and is provided, on the surface thereof, with a plurality of convex sections which are regularly arranged in an axial direction parallel to the rotational axis and in a circumferential direction orthogonal to the axial direction and parallel to a circumferential surface of the toner carrier roller and a concave section which surrounds the convex sections;

a seal member that is arranged in abutting contact with the surface of the toner carrier roller moving from the outside the housing toward the inside the housing at a position downstream of the opposed position in a rotation direction of the toner carrier roller to prevent toner leakage from the inside the housing; and a moving mechanism that relatively moves the toner carrier roller relative to the seal member in the axial direction, wherein the convex sections are arranged in the axial direction at a specified arrangement pitch, a relative movement amount of the toner carrier roller relative to the seal member in the axial direction by the moving mechanism is equal to or larger than half the arrangement pitch, the moving mechanism relatively moves the toner carrier roller relative to the seal member by a distance equal to or larger than half the arrangement pitch while the toner carrier roller rotates about the rotational axis, and the moving mechanism relatively moves the toner carrier roller relative to the seal member during at least one of acceleration and deceleration of the toner carrier roller, the acceleration being a time until a rotation speed of the toner carrier roller reaches a specified constant speed from a stationary state, the deceleration being a time until the toner carrier roller reaches the stationary state from a rotational state at the constant speed.

6. The image forming apparatus according to claim 5, comprising a removal controller that is adapted to execute a removal operation sequence in which the moving mechanism relatively reciprocates the toner carrier roller relative to the seal member in the axial direction.

7. The image forming apparatus according to claim 5, wherein the moving mechanism includes a driver, a gear pair and a biasing member, wherein the driver generates a driving force that rotates the toner carrier roller in a specified rotation direction, wherein the gear pair has one gear that is connected with the driver and other gear that is fixed to the toner carrier roller, and is adapted to transmit the driving force to the toner carrier roller and to thrust the toner carrier roller in the axial direction due to the driving force, and wherein the biasing member biases the toner carrier roller in a direction opposite to a thrusting direction of the toner carrier roller due to the driving force.

8. An image forming method, comprising;

forming a toner layer on a surface of a toner carrier roller with toner stored in a housing, the toner carrier roller being shaped approximately like a cylinder, being rotatable about a rotational axis, and being provided, on the surface thereof, with a plurality of convex sections which are regularly arranged in an axial direction parallel to the rotational axis and in a circumferential direction orthogonal to the axial direction and parallel to a circumferential surface of the toner carrier roller and a concave section which surrounds the convex sections, the convex sections being arranged in the axial direction at a specified arrangement pitch;

rotating the toner carrier roller to convey the toner to an opposed position facing a latent image carrier that carries an electrostatic latent image, thereby developing the electrostatic latent image with the toner;

bringing a seal member into abutting contact with the surface of the toner carrier roller at a position downstream of the opposed position in a rotation direction of the toner carrier roller, thereby collecting the toner into the housing; and executing selectively either one of two rotation modes in which relative positions of the seal member and the toner carrier roller in the axial direction differ by an odd number multiple of half the arrangement pitch to rotate the toner carrier roller.

9. An image forming method, comprising:

forming a toner layer on a surface of a toner carrier roller with toner stored in a housing, the toner carrier roller being shaped approximately like a cylinder, being rotatable about a rotational axis, and being provided, on the surface thereof, with a plurality of convex sections which are regularly arranged in an axial direction parallel to the rotational axis and in a circumferential direction orthogonal to the axial direction and parallel to a circumferential surface of the toner carrier roller and a concave section which surrounds the convex sections, the convex sections being arranged in the axial direction at a specified arrangement pitch;

rotating the toner carrier roller to convey the toner to an opposed position facing a latent image carrier that carries an electrostatic latent image, thereby developing the electrostatic latent image with the toner;

bringing a seal member into abutting contact with the surface of the toner carrier roller at a position downstream of the opposed position in a rotation direction of the toner carrier roller, thereby collecting the toner into the housing; and executing a removal operation by relatively moving the toner carrier roller relative to the seal member in the axial direction by a distance equal to or larger than half the arrangement pitch while rotating the toner carrier roller about the rotational axis, and relatively moving the toner carrier roller relative to the seal member during at least one of acceleration and deceleration of the toner carrier roller, the acceleration being a time until a rotation speed of the toner carrier roller reaches a specified constant speed from a stationary state, the deceleration being a time until the toner carrier roller reaches the stationary state from a rotational state at the constant speed.

* * * * *